US009022377B2

(12) United States Patent
Masunari et al.

(10) Patent No.: US 9,022,377 B2
(45) Date of Patent: May 5, 2015

(54) SHEET PROCESSING APPARATUS

(75) Inventors: Kazushige Masunari, Tokyo (JP); Yumiko Kato, Tokyo (JP)

(73) Assignee: Gradco Japan Ltd., Shinagawa-ku, Tokyo (JP)

( * ) Notice: Subject to any disclaimer, the term of this patent is extended or adjusted under 35 U.S.C. 154(b) by 8 days.

(21) Appl. No.: 13/400,374

(22) Filed: Feb. 20, 2012

(65) Prior Publication Data

US 2013/0028698 A1 Jan. 31, 2013

(30) Foreign Application Priority Data

Jul. 26, 2011 (JP) ..... 2011-163455

(51) Int. Cl.
*B65H 33/08* (2006.01)
*B65H 31/30* (2006.01)
*B65H 39/10* (2006.01)

(52) U.S. Cl.
CPC ..... *B65H 31/3027* (2013.01); *B65H 39/10* (2013.01); *B65H 2301/4213* (2013.01); *B65H 2403/724* (2013.01); *B65H 2404/1114* (2013.01); *B65H 2405/11141* (2013.01); *B65H 2511/20* (2013.01); *B65H 2513/104* (2013.01); *B65H 2801/27* (2013.01)

(58) Field of Classification Search
USPC ..... 271/3.01, 3.03, 3.06, 3.09, 3.13
See application file for complete search history.

(56) References Cited

U.S. PATENT DOCUMENTS

| | | | | | |
|---|---|---|---|---|---|
| 4,958,820 | A * | 9/1990 | Johdai et al. | ..... | 270/58.27 |
| 5,008,713 | A * | 4/1991 | Ozawa et al. | ..... | 399/402 |
| 5,090,674 | A * | 2/1992 | Ozawa | ..... | 271/3.03 |
| 5,305,995 | A * | 4/1994 | Nakajima et al. | ..... | 271/18 |
| 5,342,038 | A * | 8/1994 | Suter | ..... | 271/198 |
| 5,488,463 | A * | 1/1996 | Nimura et al. | ..... | 399/381 |
| 6,338,479 | B1 * | 1/2002 | Van Der Werff et al. | .... | 271/3.01 |
| 7,766,327 | B2 * | 8/2010 | DeGruchy | ..... | 271/272 |
| 7,832,719 | B2 * | 11/2010 | Van Den Berg | ..... | 271/3.03 |
| 8,020,865 | B2 * | 9/2011 | Bober et al. | ..... | 271/272 |

* cited by examiner

*Primary Examiner* — Ernesto Suarez
(74) *Attorney, Agent, or Firm* — Flynn, Thiel, Boutell & Tanis, P.C.

(57) ABSTRACT

A sheet processing apparatus includes a sheet conveying path; a sheet entrance unit provided in the sheet conveying path; a sheet discharge unit provided in a location separated from the sheet entrance unit by a predetermined distance; a driving unit that drives the sheet entrance unit and the sheet discharge unit; a sheet guide unit that guides sheets and is provided between the sheet entrance unit and the sheet discharge unit to allow the sheets passing through the sheet entrance unit to be sequentially stacked; and a sheet buffer device that is configured such that the stacked sheets pass through the sheet discharge unit while the stacked sheets are loaded on a step with each leading end of the stacked sheets being separated with a predetermined interval.

2 Claims, 54 Drawing Sheets

(a)

(b)

SHEET PROCESSING APPARATUS

BACKGROUND OF THE INVENTION

1. Field of the Invention

The present invention relates to a sheet processing apparatus which is a peripheral device of an image-forming apparatus such as a printer, a copy machine, and a printing machine.

2. Description of the Related Art

In an image-forming apparatus such as a copy machine, a printer, and a multi-function peripheral, a sheet processing apparatus is provided detachably. For example, as the image-forming apparatus is made work online, a copy machine or a printer has been widely used in which an image is formed on a sheet on the basis of image data transmitted from a host computer such as a personal computer through a communication line such as a LAN, and post-processing is performed with respect to the sheets with an image formed thereon, such as binding the sheets with a stapler, punching the sheets, folding the sheets, and the like (see Japanese Patent Application Laid-Open No. 10-120284).

The sheet processing apparatus may include a sheet buffer device in which sheets are loaded on a step and the sheets are discharged with the leading end of each sheet being separated from the next sheet with a predetermined interval to the sheet conveyance path. For example, the sheet buffer device includes a binder for binding the sheets discharged from the image-forming apparatus, a complier for causing the loaded sheets to wait prior to the binding processing, a sheet conveyance path for conveying the sheets to the complier or the like, and a stacker for discharging and loading the bound sheets outside the apparatus.

In such a typical sheet processing apparatus, conveyance of the sheets on the sheet conveyance path is interrupted, and a standby state is maintained while the sheets are aligned on the complier and bound using a binder. Therefore, in the typical sheet processing apparatus of the related art, since conveyance of the sheets is interrupted so that the loaded sheets are aligned and bound, the work efficiency of the sheet processing apparatus may be degraded due to the interrupt time, and the processing speed may be delayed.

SUMMARY OF THE INVENTION

The invention has been made to address such problems and provides a sheet processing apparatus capable of buffering a certain number of sheets on the sheet conveyance path and quickly discharging the buffered sheets, thereby improving the processing capacity.

In order to address the aforementioned problems and achieve the object, the invention is configured as follows.

The invention according to a first aspect is a sheet processing apparatus which includes a sheet conveying path, a sheet entrance unit provided in the sheet conveying path, a sheet discharge unit provided in a location separated from the sheet entrance unit by a predetermined distance, a driving unit configured to drive the sheet entrance unit and the sheet discharge unit, a sheet guide unit configured to guide sheets, the sheet guide unit being provided between the sheet entrance unit and the sheet discharge unit to allow the sheets passing through the sheet entrance unit to be sequentially stacked, and a sheet buffer device configured such that the stacked sheets pass through the sheet discharge unit while the stacked sheets are loaded on a step with each leading end of the stacked sheets being separated by a predetermined interval, wherein a paddle configured to smoothly convey the sheets is provided over the sheet guide unit, the sheet entrance unit has a sheet entrance roller, the sheet discharge unit has a sheet discharge roller, the driving unit has a power transmission unit and a driving motor, the paddle, the sheet entrance roller, and the sheet discharge roller are rotated together by the power transmission unit by driving the driving motor, and a controller accelerates the rotation of the sheet discharge roller relative to the rotation of the sheet entrance roller.

The invention according to a second aspect is the sheet processing apparatus according to the first aspect which includes a clutch unit configured to control the driving of the sheet discharging unit, and at least one sheet sensor configured to sense the conveyance of the sheets to a predetermined position in the sheet conveyance path, in which the controller controls the clutch unit based on a signal of the sheet sensor such that the stacked sheets pass through the sheet discharge unit while being loaded on a step with each front end of the stacked sheets being separated with a predetermined interval. The invention according to a third aspect is the sheet processing apparatus according to the first or second aspect, in which the controller performs such a control that the driving motor is driven after a predetermined time so as to rotate the sheet discharge roller, and the sheet discharge roller is continuously rotated for a predetermined time.

The present invention has the following effects by the above configuration.

In the invention according to the first aspect, the sheets are guided to allow the sheets passing through the sheet entrance unit to be sequentially stacked between the sheet entrance unit and the sheet discharge unit. The stacked sheets pass through the sheet discharge unit while the stacked sheets are loaded on a step with each leading end of the stacked sheets being separated by a predetermined interval so that a certain number of sheets can be buffered in the sheet conveyance path. In addition, the paddle, the sheet entrance roller, and the sheet discharge roller are rotated at the same time by the power transmission unit by driving the driving motor. A capacity of quickly discharging the buffered sheets can be improved by accelerating the rotation of the sheet discharge roller relative to the rotation of the sheet entrance roller.

In the invention according to the second aspect, the clutch unit is controlled based on the signal of the sheet sensor. Therefore, it is possible to discharge the sheet to be buffered while the stacked sheets are loaded on a step with each leading end of the stacked sheets being separated by a predetermined interval.

In the invention according to the third aspect, it is possible to make the sheets discharged from the sheet conveyance path have a step shape by driving the driving motor after a predetermined time to rotate the sheet discharge roller and keep rotating for a certain time. Therefore, the sheets discharged from the sheet conveying path can have a step shape.

DETAILED DESCRIPTION OF THE PREFERRED EMBODIMENTS

Hereinafter, embodiments of the sheet processing apparatus of the invention will be described. The embodiments of the invention which describe the best mode of the invention are not intended to limit the invention. The sheet processing apparatus of the invention is a peripheral device of an image-forming apparatus such as a printer, a copy machine, and a printing machine and is combined with the image-forming apparatus to perform post-processing for the sheets subjected to a job from the image-forming apparatus.

First Embodiment

Figure 1:
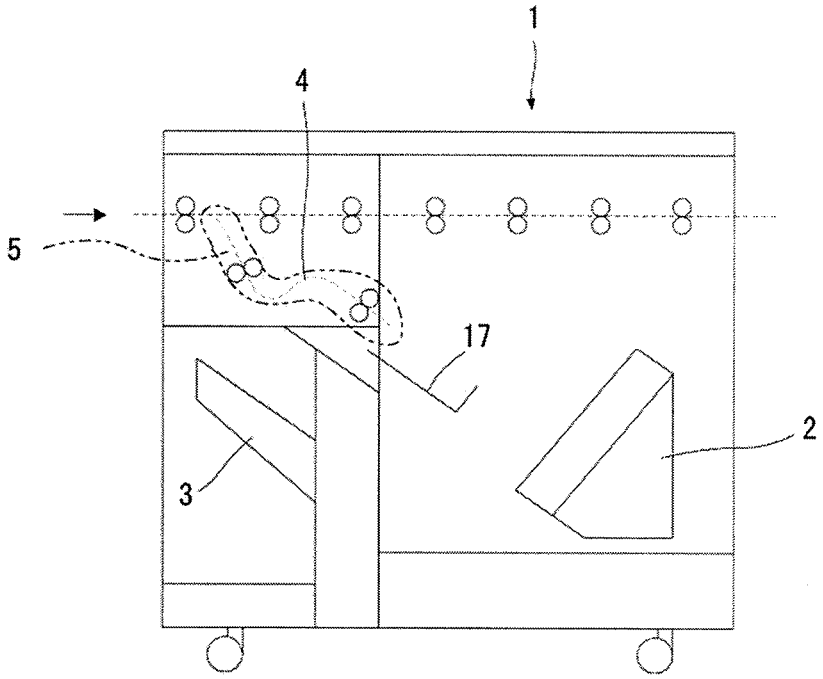
FIG. 1 is a diagram illustrating a structure of a sheet processing apparatus.

As illustrated in FIG. 1, the sheet processing apparatus 1 includes, for example, a binder 2 for binding the sheets discharged from the image-forming apparatus, a complier 17 for making the loaded sheets wait prior to the binding processing, a sheet conveying path 4 for conveying the sheets to the compiler 17 or the like, and a stacker 3 for discharging and stacking the bound sheets to an outer side, and the like.

The sheet processing apparatus 1 maintains a standby state by stopping the conveyance of the sheets in the sheet conveyance path 4 while aligning the sheets on the complier 17 and binding them using a binder 2. Therefore, since the sheet processing apparatus 1 interrupts the conveyance of the sheets between aligning and binding the stacked sheets, the operational efficiency of the sheet processing apparatus may be degraded for the interrupt time, and the processing speed may be delayed. In particular, when a small number of sheets are set and reprocessed, the conveyance standby cycle of the sheets in the sheet conveyance path 4 is expedited. Therefore, the overall standby time increases, and the processing efficiency of the sheet processing apparatus 1 is significantly degraded.

Figure 2:
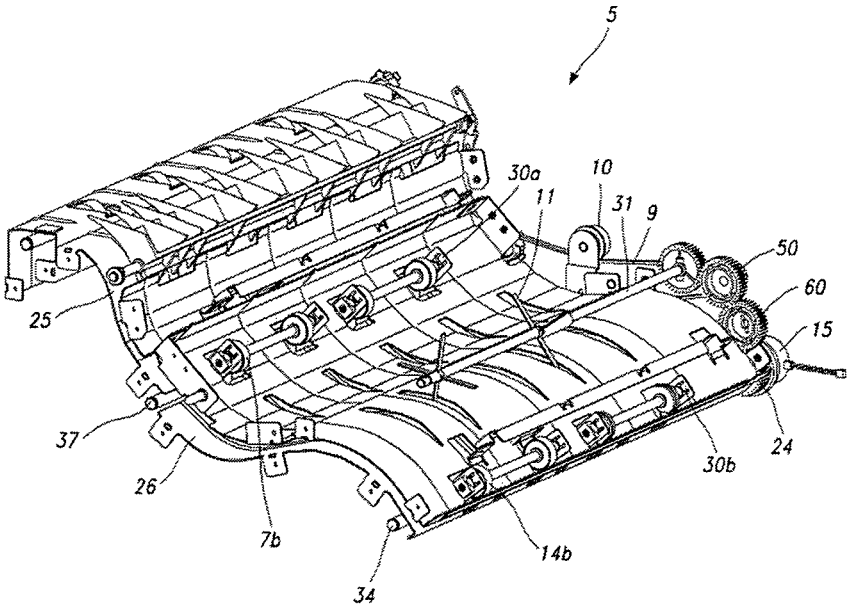
FIG. 2 is a perspective view illustrating a sheet buffer device as seen from one side.
Figure 3:
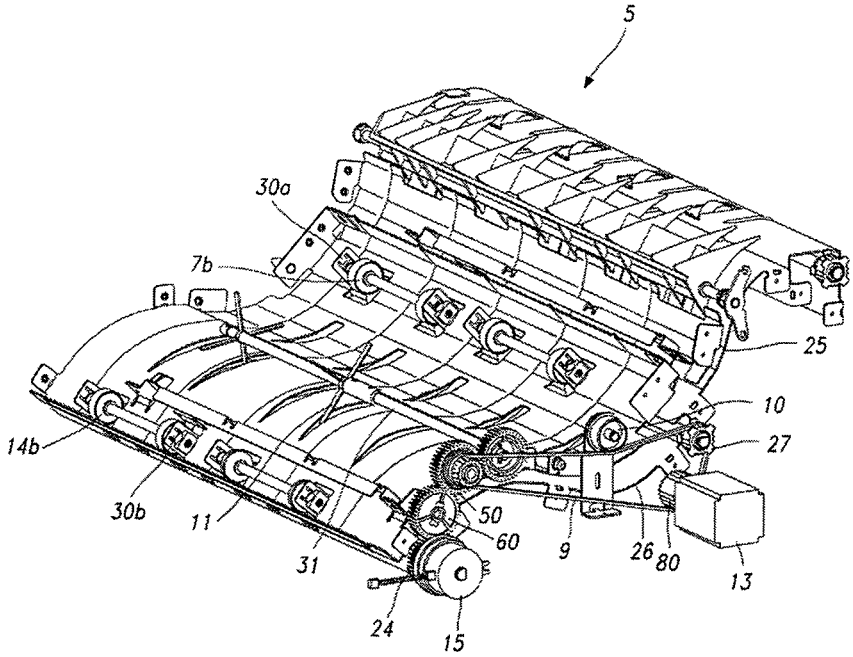
FIG. 3 is a perspective view illustrating the sheet buffer device as seen from another side.
Figure 4:
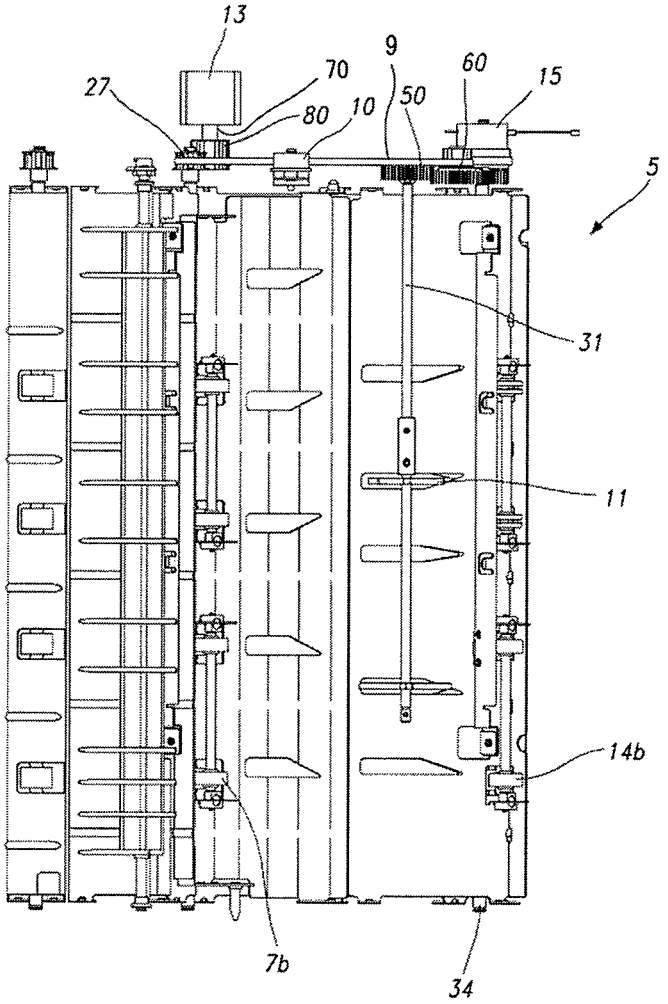
FIG. 4 is a plan view illustrating the sheet buffer device.
Figure 5:
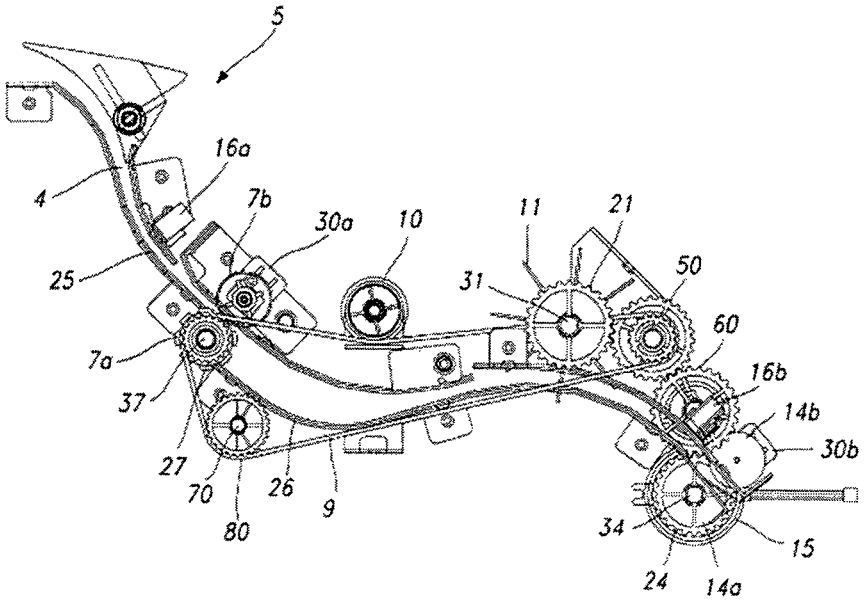
FIG. 5 is a cross-sectional side view illustrating a structure of the sheet buffer device.
Figure 7:
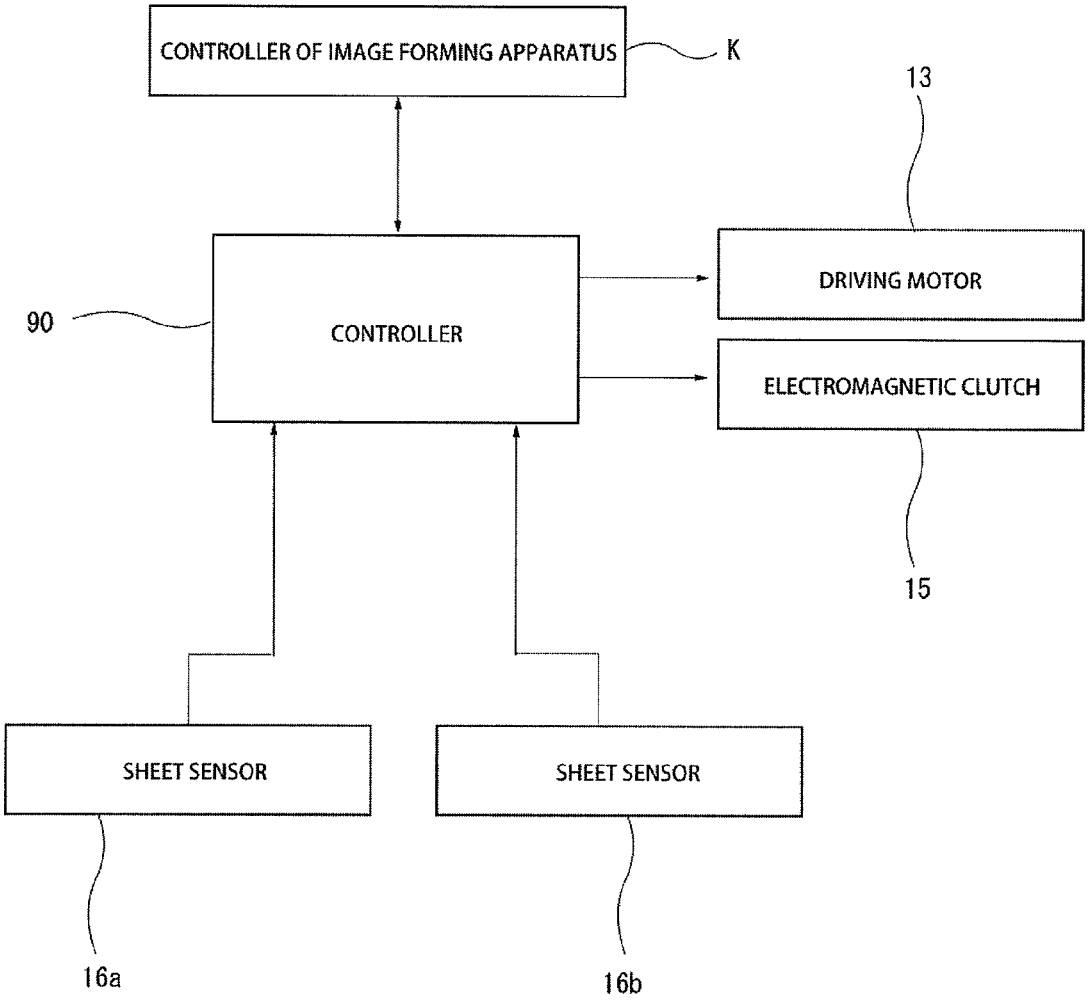
FIG. 7 is a block diagram illustrating a control mechanism.
Figure 8:
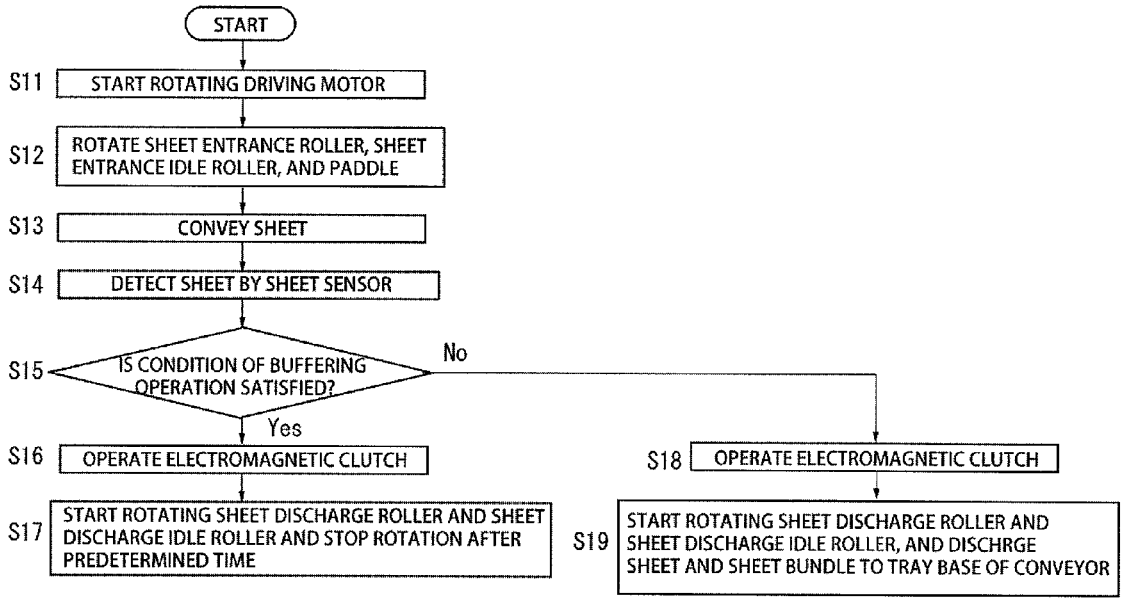
FIG. 8 is a flowchart illustrating the operational procedure of the sheet buffer device.

The sheet processing apparatus 1 of the invention includes the sheet buffer device 5 capable of buffering a certain number of sheets in the sheet conveyance path 4. FIG. 2 is a perspective view illustrating the sheet buffer device as seen from one side. FIG. 3 is a perspective view illustrating the sheet buffer device as seen from another side. FIG. 4 is a plan view illustrating the sheet buffer device. FIG. 5 is a cross-sectional side view illustrating a structure of the sheet buffer device. FIGS. 6A to 6H are cross-sectional side views illustrating the operational procedure of the sheet buffer device. FIG. 7 is a block diagram illustrating the control mechanism. FIG. 8 is a flowchart illustrating the operational procedure of the sheet buffer device.

The sheet buffer device 5 according to the embodiment includes a sheet entrance unit configured to a sheet entrance roller 7*a* configured in the lower end of the sheet conveyance path 4 and a sheet entrance idle roller 7*b* provided to abut on the roller surface following the rotation of the sheet entrance roller 7*a*. The sheet entrance idle roller 7*b* is provided in a spring device 30*a* so as to rotate while it is biased to the surface of the sheet entrance roller 7*a*.

A sheet discharge unit including a sheet discharge roller 14*a* and a sheet discharge idle roller 14*b* provided to abut on the roller surface so as to follow the rotation of the sheet discharge roller 14*a* is provided in a location separated from the sheet entrance roller 7*a* and the sheet entrance idle roller 7*b* at a predetermined distance. Similar to the sheet entrance idle roller 7*b*, the sheet discharge idle roller 14*b* is provided in a spring device 30*b* so as to rotate while it is biased to the surface of the sheet discharge roller 14*b*.

A paddle 11 is arranged in a predetermined position between the sheet entrance roller 7*a* and the sheet discharge roller 14*a* and smoothly guides the sheet conveyed from the sheet entrance roller 7*a* to the sheet discharge roller 14*a*. The sheet entrance roller 7*a*, the sheet discharge roller 14*a*, and the paddle 11 are provided to rotate by rotational axes 37, 34, and 31 where gears 27, 24, and 21, respectively, are fixed.

In particular, an electromagnetic clutch 15, which performs a control function so as to selectively transmit the rotation force transmitted from the gear 24 to the sheet discharge roller 14*a*, is provided in the rotational axis 34 where the sheet discharge roller 14*a* is fixed. Since commonly known techniques may be used for the electromagnetic clutch 15, the technical description thereof will not be repeated. However, various clutch units may be used without limiting the electromagnetic clutch 15. The gear 24 fixed to the rotational axis 34 and the gear 21 fixed to the rotational axis 31 can rotate through connection gears 50 and 60.

A driving axis 70 of a driving motor 13 is provided with a gear 80 and a power transmission unit provided to transmit a rotating power to gears 80 and 27 and the connection gear 50 using a timing belt 9. The sheet entrance roller 7*a*, the paddle 11, and the sheet discharge roller 14*a* rotate together by the power transmission unit.

In the present embodiment, although description is made for an example in which the paddle 11 and the sheet discharge roller 14*a* are indirectly driven by the connection gears 50 and 60, the invention is not limited thereto. The paddle 11 and the sheet discharge roller 14*a* may be directly driven by a separate power transmission unit. Moreover, a tension roller 10 of the timing belt 9 is provided to maintain a proper tension and a tensile force of the timing belt 9.

In order to sequentially stack the sheets passing through a gap between the sheet entrance roller 7*a* and the sheet entrance idle roller 7*b*, the lower end guide plate 26 of the sheet conveyance path 4 located under the sheet entrance roller 7*a* is lower than the upper end guide plate 25 of the sheet conveyance path 4 located over the sheet entrance roller 7*a*.

Since the lower end guide plate 26 is provided to be lower than the upper end guide plate 25 with respect to the sheet entrance roller 7*a*, the sheets passing through the sheet entrance roller 7*a* is guided and accurately stacked on the lower end guide plate 26 without changing the sequence.

Moreover, sheet sensors 16*a* and 16*b* are provided in the vicinity of the sheet conveyance path 4 located in the upper end of the sheet entrance roller 7*a* and the sheet discharge roller 14*a* to sense the conveyance, discharge, and jamming of the sheets or the like.

Next, the operational procedure of the sheet buffer device 5 will be described in detail with reference to FIGS. 6A to 6H, 7, and 8. In the present embodiment, a controller 90 is connected to a controller K of the image-forming apparatus, and the controller 90 is driven based on the signal from the controller K.

The rotation of the driving motor 13 is initiated under control of the controller 90 in step S11, and the sheet entrance roller 7*a*, the sheet entrance idle roller 7*b*, and the paddle 11 are rotated by virtue of the driving of the driving motor 13 in step S12. While the rotation of the sheet discharge roller 14*a* and the sheet discharge idle roller 14*b* stop by the electromagnetic clutch 15, if a first sheet S1 is conveyed from the sheet conveyance path 4 in step S13 as illustrated in FIG. 6A, the sheet sensor 16*a* senses the first sheet S1 and transmits the signal to the controller 90 in step S14.

The controller 90 performs a control function such that the rotational power is transmitted to the sheet discharge roller 14*a* within a predetermined time by operating the electromagnetic clutch 15 after a predetermined time in step S15.

Figure 6A:
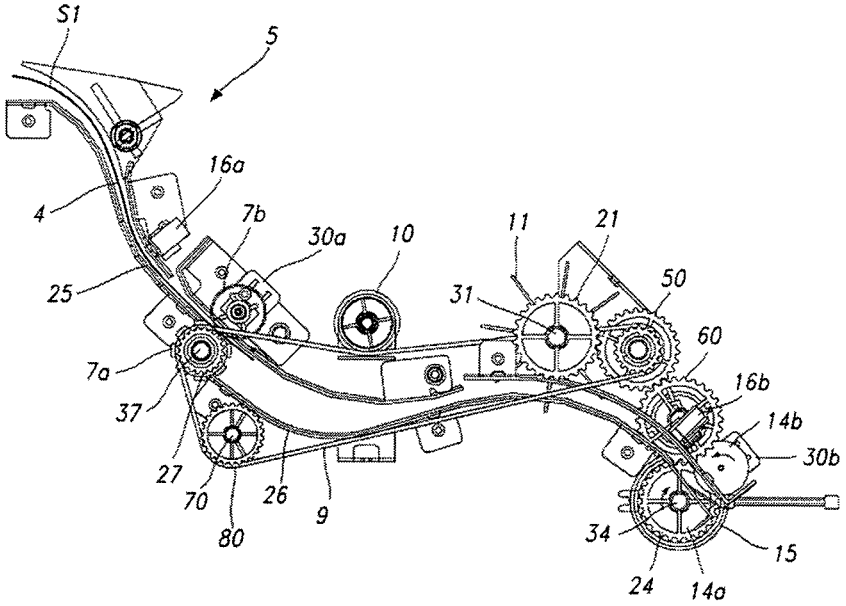
FIG. 6A is a cross-sectional side view illustrating an operational procedure of the sheet buffer device.
Figure 6B:
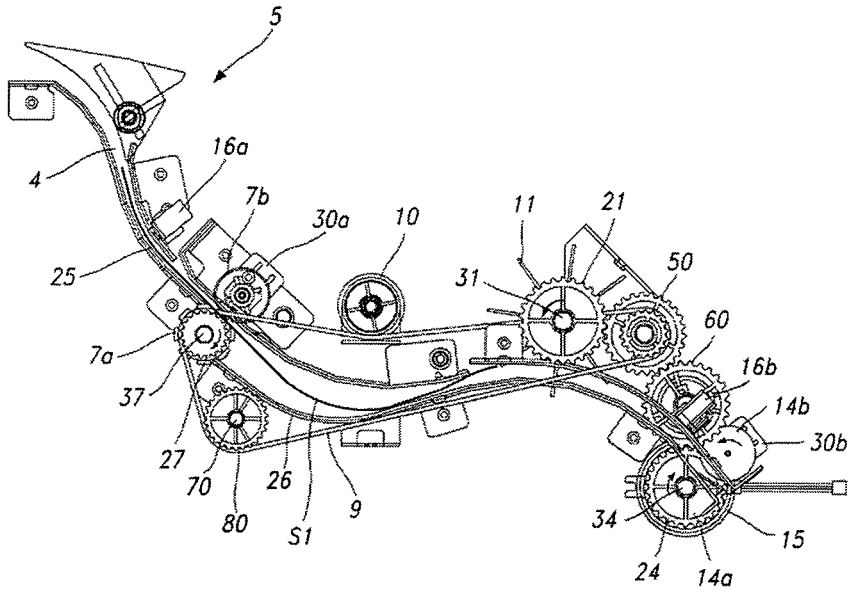
FIG. 6B is a cross-sectional side view illustrating the operational procedure of the sheet buffer device.

In the state of FIG. 6A, if the sheet S1 passes through a gap between the sheet entrance roller 7*a* and the sheet entrance idle roller 7*b* and moves down to the paddle 11 side, the leading end of the sheet S1 is smoothly guided to the sheet discharge roller 14*a* side by the rotating paddle 11 as illustrated in FIG. 6B.

Figure 6C:
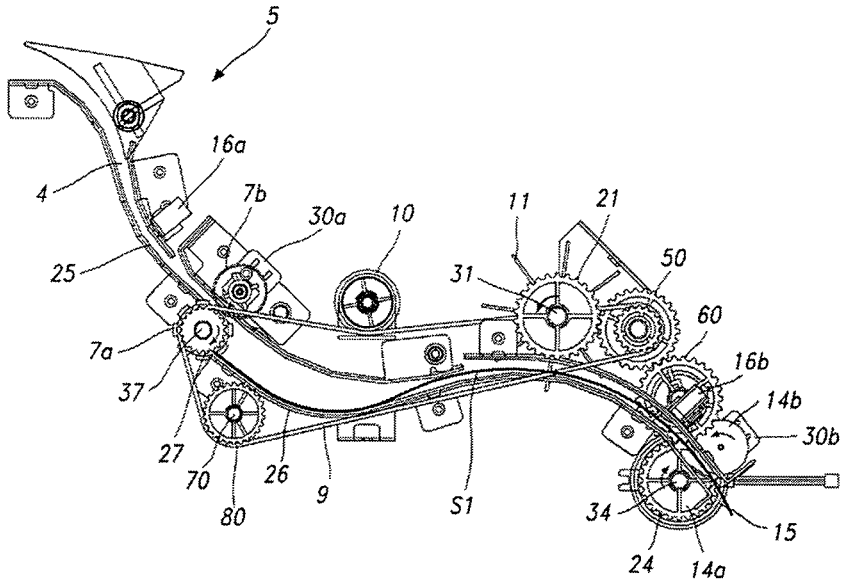
FIG. 6C is a cross-sectional side view illustrating the operational procedure of the sheet buffer device.

Subsequently, as the sheet is conveyed to the sheet discharge roller 14*a* side as illustrated in FIG. 6C, the electromagnetic clutch 15 is operated, so that the sheet starts to be discharged while the leading end of the sheet S1 is nipped between the sheet discharge roller 14*a* and the sheet discharge idle roller 14*b* for a driving timing of the electromagnetic clutch 15 in step S16. While the leading end of the sheet S1 slightly protrudes from a gap between the sheet discharge roller 14*a* and the sheet discharge idle roller 14B, the rotation of the sheet discharge roller 14*a* stops, and the buffering of the sheet S1 is terminated in step S17.

At this time, the driving timing of the electromagnetic clutch 15 is set such that the trailing end of the sheet S1 is completely discharged from the sheet entrance roller 7*a* and the sheet entrance idle roller 7*b* and safely arrives at the guide plate 26 while the sheets are buffered in the sheet buffer device 5 as illustrated in FIG. 6C.

Figure 6D:
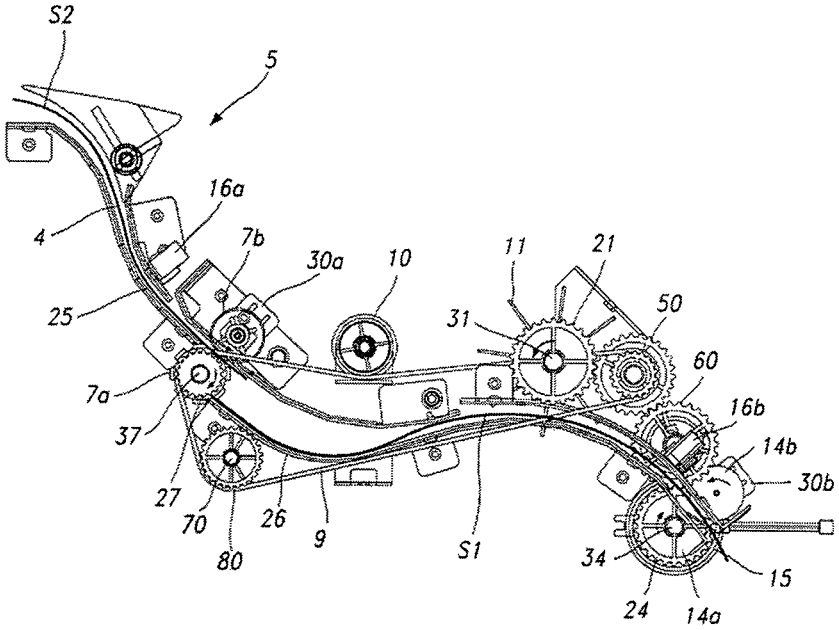
FIG. 6D is a cross-sectional side view illustrating the operational procedure of the sheet buffer device.

Subsequently, even when the rotation of the sheet discharge roller 14*a* stops, the sheet entrance roller 7*a* continues to rotate by the driving of the driving motor 13. Therefore, as illustrated in FIG. 6D, a second sheet S2 preceded by the sheet S1 passes through a gap between the sheet entrance roller 7*a* and the sheet entrance idle roller 7*b* from the sheet conveyance path 4 side and moves down. The sheet S2 is sensed by the sheet sensor 16*a*, as with the sheet S1, and the electromagnetic clutch 15 is re-operated after a predetermined time so that the sheet discharge roller 14*a* is operated within a predetermined time.

Figure 6E:
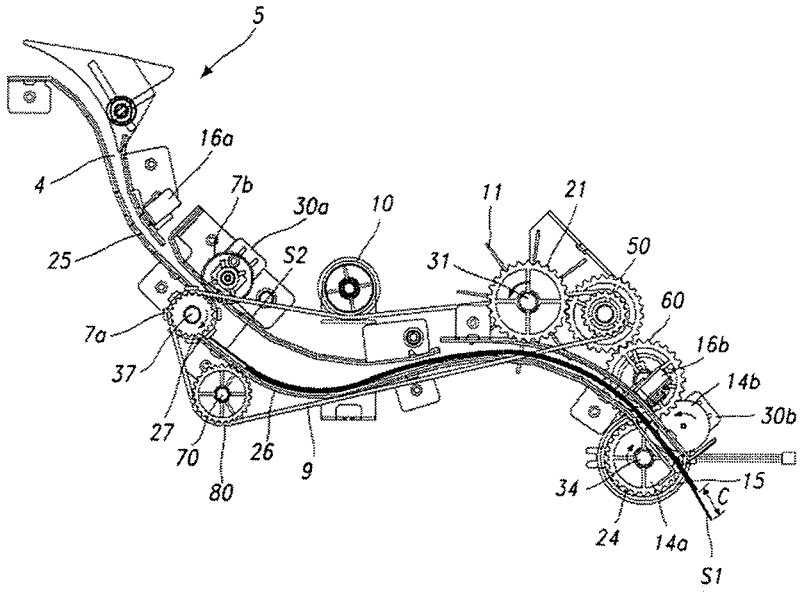
FIG. 6E is a cross-sectional side view illustrating the operational procedure of the sheet buffer device.

Subsequently, in steps S12 to S17, as illustrated in FIG. 6E, if the leading end of the second sheet S2 moves to the sheet discharge roller 14*a* side, the sheet S2 starts to be discharged along with the first sheet S1 while the leading end of the sheet S2 is nipped between the sheet discharge roller 14*a* and the sheet discharge idle roller 14*b* for a driving timing of the re-operated electromagnetic clutch 15. While the leading end of the sheet S2 slightly protrudes from a gap between the sheet discharge roller 14*a* and the sheet discharge idle roller 14*b*, the rotation of the sheet discharge roller 14*a* stops.

Therefore, the sheet S1 is discharged before a distance C to which the sheet S2 is discharged from the sheet discharge roller 14*a*. The preceding distance C between sheets may be adjusted by the operation timing of the electromagnetic clutch 15, that is, the driving timing setting of the sheet discharge roller 14*a*.

Figure 6F:
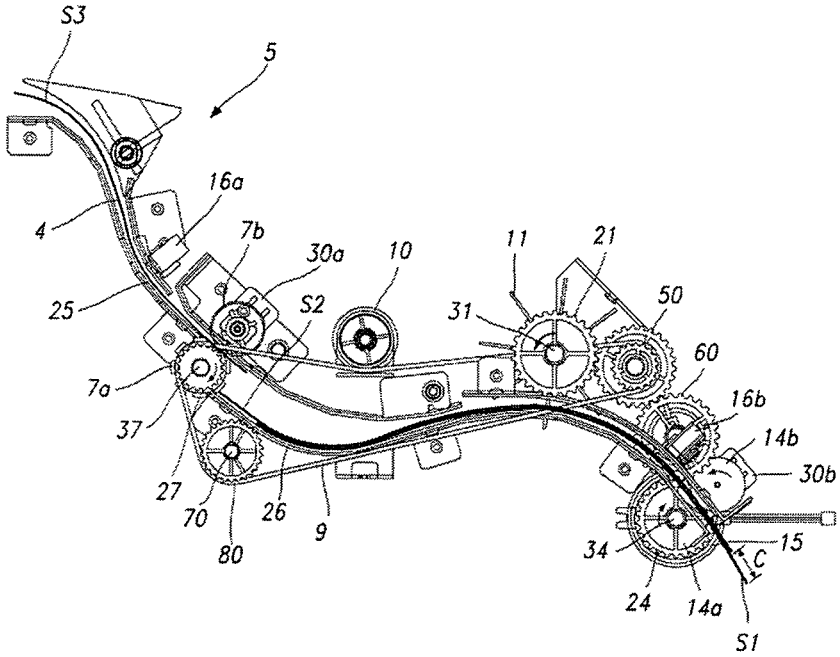
FIG. 6F is a cross-sectional side view illustrating the operational procedure of the sheet buffer device.

Subsequently, even when the rotation of the sheet discharge roller 14*a* stops after the second sheet S2 is buffered, a third sheet S3 preceded by the sheet S2 passes through a gap between the sheet entrance roller 7*a* and the sheet entrance idle roller 7*b* from the sheet conveyance path 4 side and moves down as illustrated in FIG. 6F.

The third sheet S3 is sensed by the sheet sensor 16*a* similarly to sheets S1 and S2, the electromagnetic clutch 15 is operated after a predetermined time, and the sheet discharge roller 14*a* operates within a predetermined time.

Figure 6G:
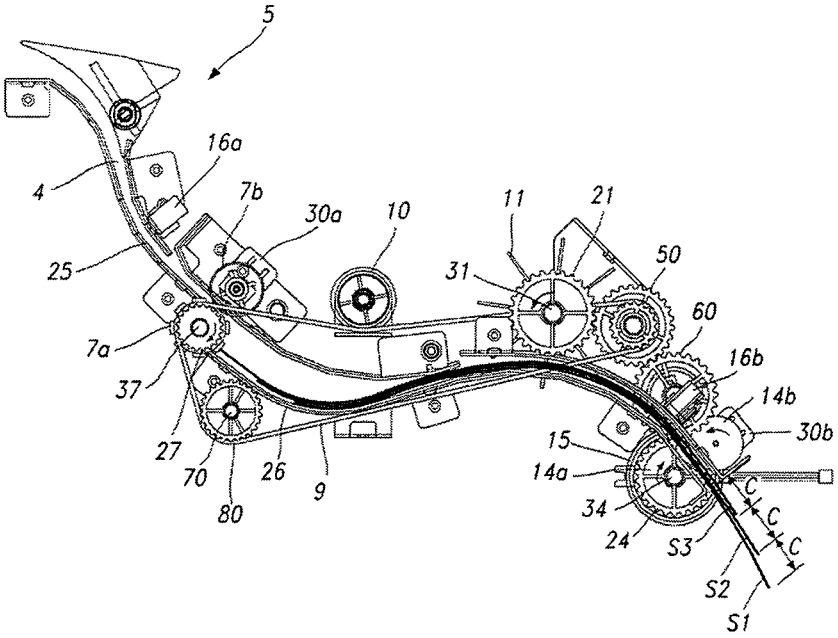
FIG. 6G is a cross-sectional side view illustrating the operational procedure of the sheet buffer device.

Subsequently, in steps S12 to S17, as illustrated in FIG. 6G, as the leading end of the third sheet S3 is conveyed to the sheet discharge roller 14*a* side, the electromagnetic clutch 15 starts to re-operate so that the sheet S3 starts to be discharged along with the sheets S1 and S2 while the leading end of the sheet S3 is nipped between the sheet discharge roller 14*a* and the sheet discharge idle roller 14*b* for a driving timing of the electromagnetic clutch 15. While the leading end of the third sheet S3 slightly protrudes from a gap between the sheet discharge roller 14*a* and the sheet discharge idle roller 14*b*, the rotation of the sheet discharge roller 14*a* stops.

Therefore, in steps S18 and S19, each of the sheets S3, S2, and S1 is discharged in a stacked state on a step at an interval C. As illustrated in FIG. 6G, in this state, for example, if a setting is made such that the sheets are buffered and discharged on a three-sheet basis, the driving time of the electromagnetic clutch 15 may be controlled such that the sheet discharge roller 14*a* continues to rotate to completely discharge three buffered sheets after the sheet sensor 16*a* senses the third sheet S3, and a predetermined time elapses. If a fourth sheet is further buffered, the same process as the buffering process of the sheet S3 may be performed.

Figure 6H:
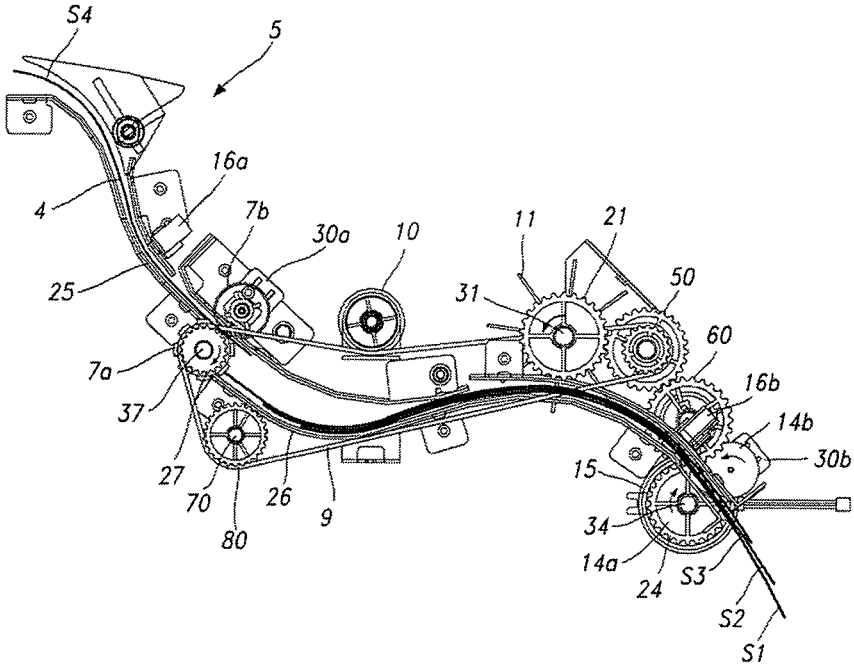
FIG. 6H is a cross-sectional side view illustrating the operational procedure of the sheet buffer device.

The discharge condition of the buffered sheet is sensed by the sheet sensor 16*b*. While the buffered sheets S1, S2, and S3 are discharged, as illustrated in FIG. 6H, the first sheet S4 of the second lot is provided through the sheet conveyance path 4.

In the present embodiment, the sheets are guided such that the sheets passing through the sheet entrance unit between the sheet entrance unit and the sheet discharge unit are sequentially stacked, and the stacked sheets pass through the sheet discharge unit while the stacked sheets are loaded on a step with each leading end of the stacked sheets being separated at a predetermined interval, so that a certain number of sheets can be buffered in the sheet conveyance path 4. In addition, the paddle 11, the sheet entrance roller 7*a*, and the sheet discharge roller 14*a* are rotated together using the timing belt 9 by driving the driving motor 13. The buffered sheets can be quickly discharged to improve the processing capacity by accelerating the rotation of the sheet discharge roller 14*a* relative to the rotation of the sheet entrance roller 7*a*.

The electromagnetic clutch 15 is controlled based on the signals output from the sheet sensors 16*a* and 16*b* so that the sheets can be buffered and output while loaded on a step with each leading end of the stacked sheets being separated at a predetermined interval. In addition, it is possible to arrange the sheets discharged from the sheet conveyance path 4 in a step shape by driving the driving motor 13 after a predetermined time to rotate the sheet discharge roller 14*a* and keep this rotation for a predetermined time.

If the sheet buffer device 5 having a buffering function in the sheet conveyance path 4 discharges the sheets one by one instead of on a plural-page basis, the driving timing of the electromagnetic clutch 15 may be controlled such that the sheet discharge roller 14*a* is driven along with the sheet entrance roller 7*a* at all times.

As illustrated in FIGS. 1 to 5, the sheet buffer device 5 according to the present embodiment includes, on the sheet conveying path 4, the sheet entrance roller 7*a*, the sheet entrance idle roller 7*b* abutting the sheet entrance roller 7*a*, the sheet discharge roller 14*a* which is provided in a location separated from the sheet entrance roller 7*a* at a predetermined distance and of which rotation is controlled by the electromagnetic clutch 15, the sheet discharge idle roller 14*b* abutting on the sheet discharge roller 14*a*, the paddle 11 provided between the sheet entrance roller 7*a* and the sheet discharge roller 14*a*, the timing belt 9 and the driving motor 13 which are configured to simultaneously drive the sheet entrance roller 7*a*, the sheet discharge roller 14*a*, and the paddle 11, the sheet sensors 16*a* and 16*b* provided in the upper end of the sheet entrance roller 7*a* and the upper end of the sheet discharge roller 14*a*, respectively. The electromagnetic clutch 15 is turned on/off based on the signals output from the sheet sensors 16*a* and 16*b* so that the driving timing of the sheet discharge roller 14*a* can be controlled.

Since the sheet buffer device 5 is configured in such a manner, the sheets conveyed through the sheet conveying path 4 are sequentially buffered without any trouble while the sheets are sequentially loaded on a step, and the leading end of the sheet bundle is arranged at a predetermined interval and are quickly discharged through a gap between the sheet discharge roller 14*a* and the sheet discharge idle roller 14*b*.

Therefore, the sheet can be buffered and discharged without a delay in the sheet conveyance. In addition, the sheet buffer function can be simply and inexpensibly configured in the sheet conveying path 4 of the sheet processing apparatus. The operation of the sheet processing apparatus can be efficiently improved by reducing a delay in the sheet conveyance generated in the sheet buffering process.

Second Embodiment

In the sheet post-processing device according to the second embodiment, the subsequent sheets can be conveyed to the compile unit at a high speed, loaded by alignment, and discharged as a sheet bundle.

The sheet post-processing device according to the second embodiment of the invention includes: a base tray configured to load the sheets conveyed from the image-forming apparatus; a fixation jogger and a driving jogger configured to align the sheets loaded on the base tray; a compile unit having an ejector configured to eject a sheet bundle loaded on the base tray; a stacker tray arranged under the compile unit; a loaded sheet number setting unit configured to set the number of sheets loaded on the base tray; a sheet detection sensor configured to detect the sheets conveyed from the image-forming apparatus; a jogger driving unit configured to make a reciprocal movement from the standby position of the driving jogger in a sheet-width direction by a predetermined distance; and a controller configured to control the jogger driving unit, in which the controller performs control of the jogger driving unit based on the detection information from the sheet detection sensor such that the driving jogger is moved by a predetermined distance in a sheet-width direction from the standby position while the sheets are loaded on the base tray, the sheets loaded on the base tray are aligned at a position inside the surface area of the subsequent sheet conveyed from the image-forming apparatus, the subsequent sheet is loaded on the surface of the driving jogger while the sheets loaded on the base tray are aligned, the subsequent sheet loaded on the surface of the driving jogger is loaded on the base tray by moving the driving jogger to the original standby position while the subsequent sheet is loaded on the surface of the driving jogger, a reciprocal movement from the standby position of the driving jogger in a sheet-width direction by a predetermined distance is repeated, and the sheets are loaded and aligned on the base tray as many as the setting sheet number.

The driving jogger is moved by a predetermined distance in a sheet-width direction from the standby position while the sheets are loaded on the base tray based on the detection information from the sheet detection sensor, so that the sheets loaded on the base tray are aligned at a position inside the surface area of the subsequent sheet conveyed from the image-forming apparatus. The subsequent sheet loaded on the surface of the driving jogger is loaded on the base tray by loading the subsequent sheet on the surface of the driving jogger while the driving jogger aligns the sheet and moving the driving jogger to the original standby position while the subsequent sheet is loaded on the surface of the driving jogger. A reciprocal movement from the standby position of the driving jogger in a sheet-width direction by a predetermined distance is repeated. Therefore, it is possible to convey and load sheets at a high speed without interference between the sheet on the base tray and the subsequent sheet by loading the sheets on the base tray as many as the setting sheet number and using the operation of the driving jogger.

The sheet post-processing device includes the sheet size setting unit for setting the size of the sheets conveyed from the image-forming apparatus, and the controller sets a predetermined distance for a reciprocal movement from the standby position of the driving jogger in a sheet-width direction based on the size of the sheet width set by the sheet size setting unit. By setting the reciprocal distance at a predetermined position from the standby position of the driving jogger in a sheet-width direction based on the size of the sheet-width direction set, it is possible to load various sizes of sheets by aligning the sheets as many as the setting sheet number on the base tray.

The sheet post-processing device includes the paddle driving unit for driving the paddle, and the controller performs control such that the sheet detection sensor detects the leading end of the sheet, the paddle is rotated by the paddle driving unit, the forward conveyance of the sheet is suppressed by making the paddle contact with the subsequent sheet, the end surface of the trailing end of the sheet bundle is aligned, and the driving jogger moves for a predetermined distance by the jogger driving unit to align the sheet.

As the sheet detection sensor detects the leading end of the sheet, and the trailing end of the sheet is detected within a predetermined time, the forward conveyance of the sheet is suppressed by rotating the paddle by the paddle driving unit and making the paddle contact with the subsequent sheet. The end surface of the trailing end of the sheet bundle is aligned, and the driving jogger moves for a predetermined distance by the jogger driving unit to align the sheet. Therefore, it is possible to reliably align the sheet bundle without interference between the subsequent sheet and the sheet bundle.

The sheet post-processing device includes an ejector driving unit for driving the ejector and an extension tray driving unit for moving the extension tray to the stacker tray, in which the controller controls the extension tray driving unit such that the extension tray moves forward to support the leading end of the sheet bundle discharged on the stacker tray as the sheet detection sensor detects the leading end of the sheet. The controller controls the ejector driving unit and the ejector such that the trailing end of the sheet bundle is pressed after the sheets are aligned and loaded on the base tray as many as the setting sheet number. The extension tray moves backward while the sheet bundle is supported by the moving ahead extension tray, and the sheet bundle on the base tray at a standby position is discharged to the stacker tray. If the sheet detection sensor detects the leading end of the sheet after the sheet bundle is discharged to the stacker tray, the extension tray moves forward so as to support the leading end of the sheet bundle discharged to the stacker tray.

If the sheet detection sensor detects the leading end of the sheet, the extension tray moves forward to support the leading end of the sheet bundle discharged to the stacker tray. The trailing end of the sheet bundle is pressed by the ejector after the sheets are aligned and loaded on the base tray as many as the setting sheet number, so that the extension tray retreats while the sheet bundle is supported by the moving-forward extension tray. The sheet bundle on the base tray at a standby position is discharged to the stacker tray. If the sheet detection sensor detects the leading end of the sheet after the sheet bundle is discharged to the stacker tray, the extension tray moves forward to support the leading end of the sheet bundle discharged to the stacker tray so as to provide a compact structure. The extension tray move backward and is located at the standby position when the ejector finishes discharge of the sheet bundle to the stacker tray. Therefore, it is possible to reliably support the sheet bundle and discharge to the stacker tray.

When the subsequent sheet following the sheet bundle discharged to the stacker tray is conveyed on the base tray, the leading end of the subsequent sheet rides on the driving jogger and precedes the ejector which pressedly ejects the preceding sheet bundle. The trailing end of the subsequent sheet is located backward from the ejector, and the extension tray moves backward by driving the extension tray driving unit so that the sheet bundle is discharged to the stacker tray by the ejector.

When the subsequent sheet following the sheet bundle discharged to the stacker tray is conveyed to the base tray, the leading end of the subsequent sheet rides on the driving jogger and precedes the ejector which pressedly ejects the preceding sheet bundle. The trailing end of the subsequent sheet is located backward from the ejector. The extension tray moves backward to discharge the sheet bundle to the stacker tray by the ejector. Therefore, it is possible to smoothly discharge the sheet bundle to the stacker tray without interference between the subsequent sheet and the ejector and disturbing the extension tray from discharging the sheet bundle by the moving-backward extension tray.

Hereinafter, the embodiment of the sheet post-processing device of the invention will be described. The embodiments of the invention which describe the best mode of the invention are not intended to limit the invention, and may include the sheet buffer device according to the first embodiment.

Figure 9:
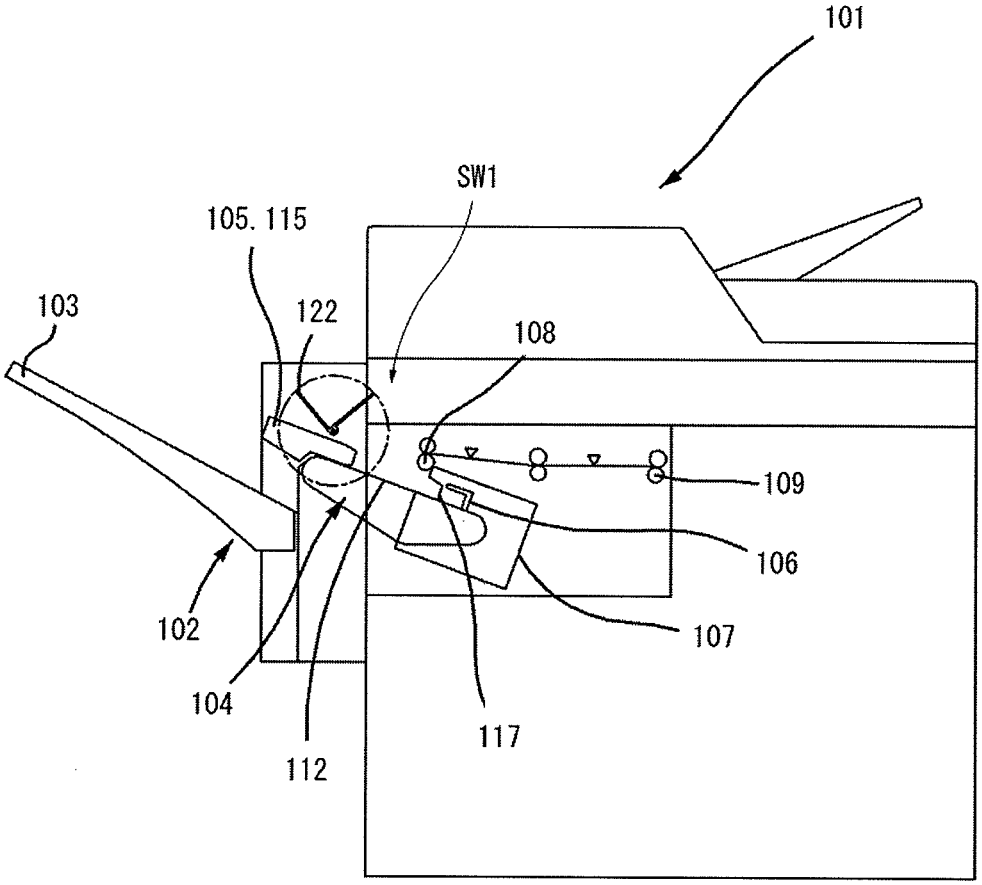
FIG. 9 is a diagram illustrating a state that a sheet post-processing device is combined to the image forming apparatus such as a copy machine.
Figure 10:
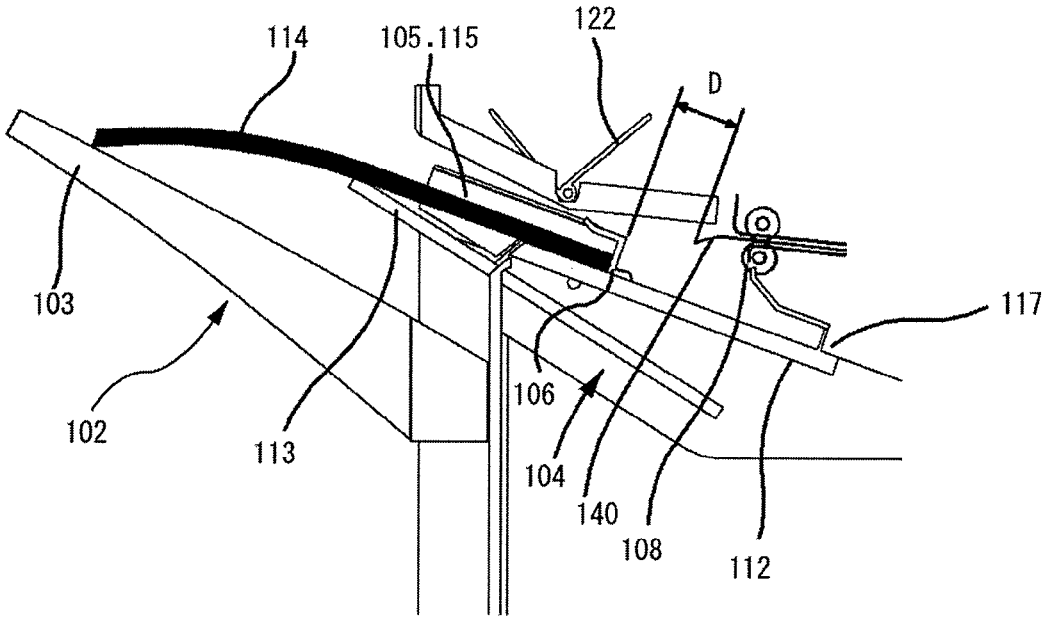
FIG. 10 is a cross-sectional view illustrating a sheet conveying state of the sheet post-processing device.
Figure 11:
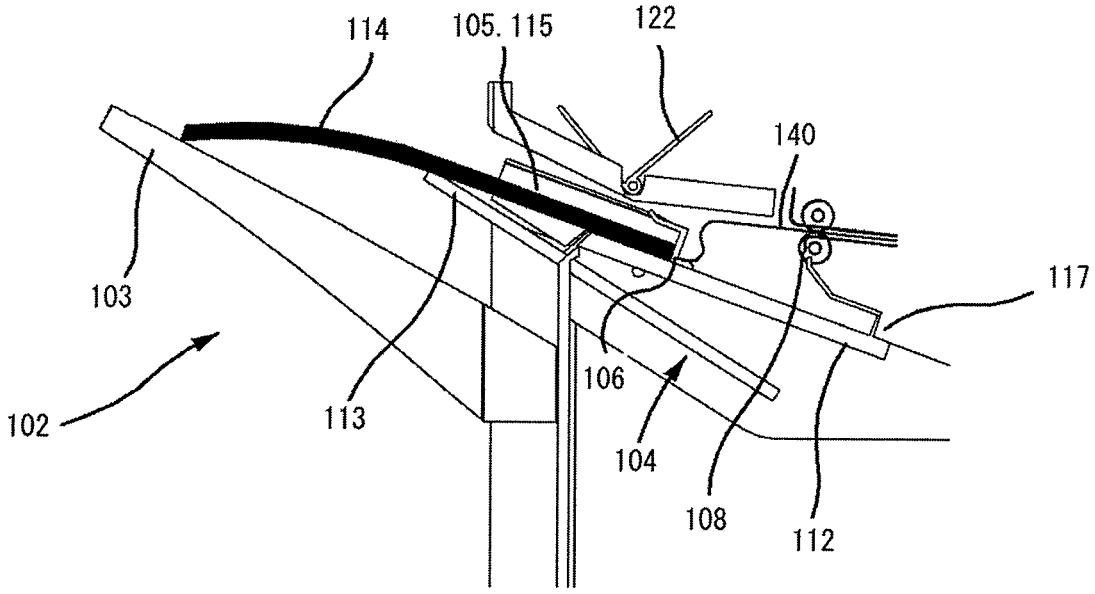
FIG. 11 is a cross-sectional view illustrating the sheet post-processing device when the interference of a sheet occurs.

The sheet post-processing device according to the present embodiment will be described with reference to FIGS. 9 to 11. FIG. 9 is a diagram illustrating a state that the sheet post-processing device is combined with the image-forming apparatus, such as a copy machine. FIG. 10 is a cross-sectional view illustrating a sheet conveying state of the sheet post-processing device. FIG. 11 is a cross-sectional view illustrating the sheet post-processing device when an interference of sheet occurs.

In the image-forming apparatus 101 such as a copy machine, a printer, and a multi-function peripheral, the sheet post-processing device 102 is provided detachably. The sheet post-processing device 102 includes the compile unit 104 and the stacker tray 103 configured under the compile unit 104. The compile unit 104 includes a pair of joggers 105 and 115, the base tray 112, the extension tray 113, the rear wall 117, the ejector 106, and the like. An additional device such as a stapler 107 which can perform the post-processing for the sheet bundle 114 loaded on the compile unit 104 is provided in the lower end of the compile unit 104.

The paddle is provided over the base tray 112 of the compile unit 104, and the entrance roller 109 and the discharge roller 108 serving as the sheet conveying unit which conveys the sheet of the compile unit 104 is provided over the paddle 122. If the sheet 14 is conveyed from the image-forming apparatus 1, the conveying sheet 14 is loaded in the compile unit 104 through the entrance roller 109 and the discharge roller 108, and then, a post-processing is performed by the stapler 107. The post-processed sheet bundle 114 is discharged to the stacker tray 103.

In the sheet post-processing device 102 configured in such a manner, as illustrated in FIG. 11, there is a structural problem in that the leading end of the subsequent sheet 140 interferes with the trailing end of the ejector 106 where the leading end of the sheet 140 is ejected while the sheet bundle 114 is discharged by the ejector 106. However, as illustrated in FIG. 2, it may be envisaged that the subsequent sheet 140 is conveyed with a delay to maintain an interval D between the trailing end of the ejector 106 and the leading end of the subsequent sheet 14 to avoid the leading end of the subsequent sheet 140 from being blocked by the ejector 106. Alternatively, the transmission speed of the ejector 106 may increase to prevent the leading end of the subsequent sheet 140 from preceding the ejector 106 by. However, there is a limitation in conveying the subsequent sheet 140 to the compile unit 104 with a high speed when the sheet bundle 114 is discharged. Therefore, the driving efficiency of the sheet post-processing device 102 is degraded.

The sheet post-processing device 102 according to the embodiment will be described with reference to FIGS. 12 to 21. The sheet post-processing device 102 according to the embodiment includes the compile unit 104 and the stacker tray 103 configured under the compile unit 104. The compile unit 104 includes the base tray 112 for loading the sheet 140 conveyed from the image-forming apparatus 1, a pair of joggers 105 and 115 for aligning the loaded sheet 14 on the based tray 112, the ejector 106 provided on the base tray 112 and configured in rear of the rear wall 117 to push the loaded sheet 140 on the base tray 112 to the outer side, and the extension tray 113 configured to protrude extending to the leading end side of the base tray 112.

Meanwhile, the stapler 107 is provided in the lower end of the base tray 112. The stapler 107 is configured to selectively staple the end of the sheet bundle 114 loaded in the compile unit 104. The paddle 122 is provided over the base tray 112 of the compile unit 104, and the entrance roller 109 and the discharge roller 108 which convey the sheet in compile unit 104 are provided over the paddle 122.

The sheet 140 is loaded on the base tray 112 through the entrance roller 109 and the discharge roller 108. In the process of loading the sheet 140 on the base tray 112, the paddle 122 made of a material such as rubber or silicon operates and smoothly touches the surface of the sheet. As a result, the trailing end of the sheet is guided downwardly to the rear wall 177, and it is possible to prevent the sheets 140 from being scattered or mixed.

In particular, one jogger 115 selected between a pair of joggers 105 and 115 may serve as a fixing jogger, and the other jogger 105 may serve as the driving jogger. The end located in the discharge roller 108 side of each jogger may be configured to have a gradient 150 and 151. The driving jogger 105 may be configured to adjust the interval in a direction perpendicular to the direction that the sheet 14 is conveyed.

In the present embodiment, description will be made as an example for a structure for adjusting the gap between the joggers by driving the jogger 105 while the jogger 115 is fixed. The sheets loaded on the base tray 112 are aligned by moving the driving jogger 105 to shift the sheets toward the fixation jogger 115 in a location separated at a predetermined distance P in a sheet-width direction perpendicular to the sheet conveyance direction.

Figure 12:
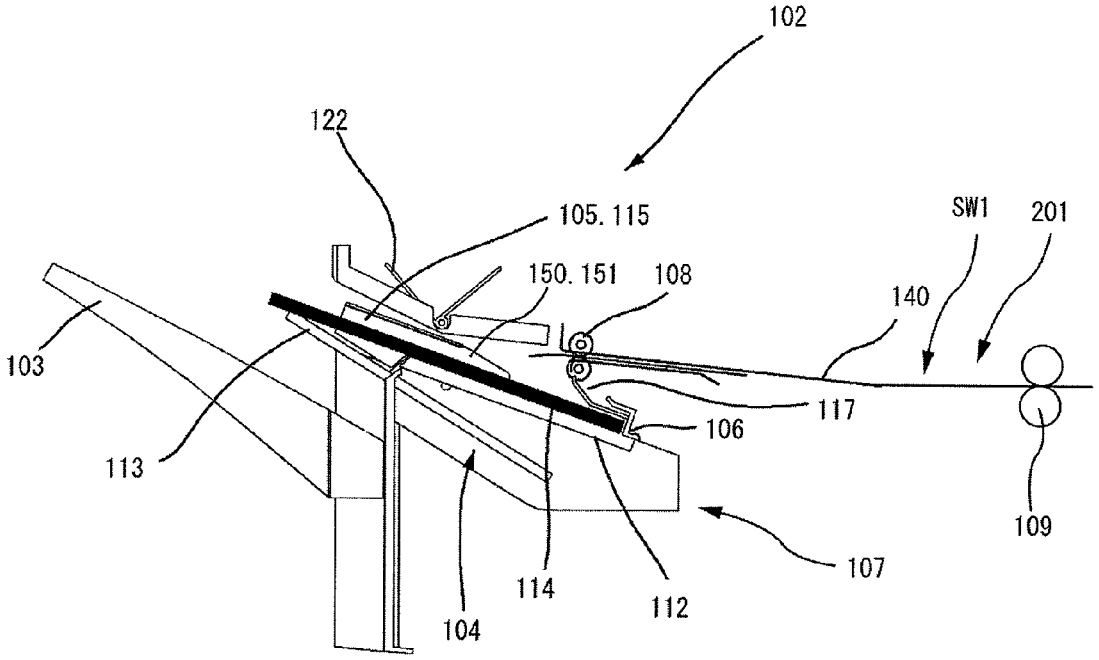
FIG. 12 is a cross-sectional view illustrating an operational procedure of the sheet post-processing device.
Figure 17:
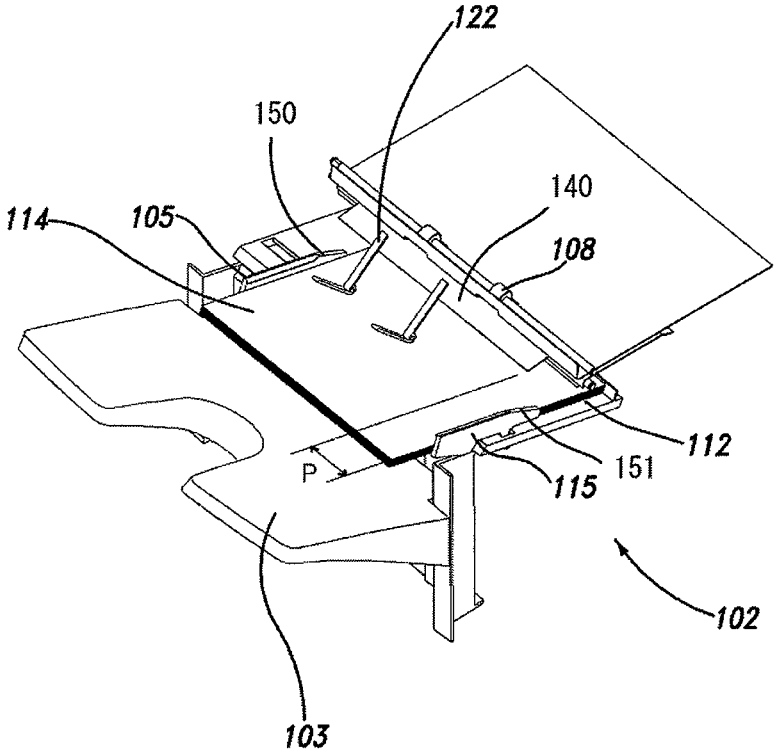
FIG. 17 is a perspective view illustrating an operational procedure of the sheet post-processing device.

In the sheet post-processing device 102 according to the present embodiment, as illustrated in FIGS. 12 and 17, as the sheet 140 is conveyed on the base tray 112 from the image-forming apparatus 101, a one-side driving jogger 105 projecting to the outer side is moved toward the other-side fixation jogger serving as a reference, and the side surface of the conveyed sheet 140 is pushed (shifted) so that the sheets are aligned and loaded until a preset sheet number.

It is preferable that the driving jogger 105 presses the side surface of the sheet 140 to shift the sheet 140 to the fixation jogger 115 side for alignment when the sheet 14 is conveyed on the base tray 112 one by one. However, the invention is not limited thereto. The sheet 140 may be shifted to the fixation jogger 115 by pressing the side surface of the loading sheet at one time while waiting until a predetermined number of sheets are loaded.

The aligned sheet 114 is loaded on the base tray 112 while being shifted to a location of a predetermined distance P from the end of the subsequent conveyed sheet 140. If a predetermined number of sheets on the base tray 112 are shifted to the position of a predetermined distance P, and the loading is completed, a single sheet bundle 114 is configured, and a stapling is performed by using the stapler 107 provided in the side of the compile unit 104 or the like so as to accomplish the sheet post-processing job.

Figure 13:
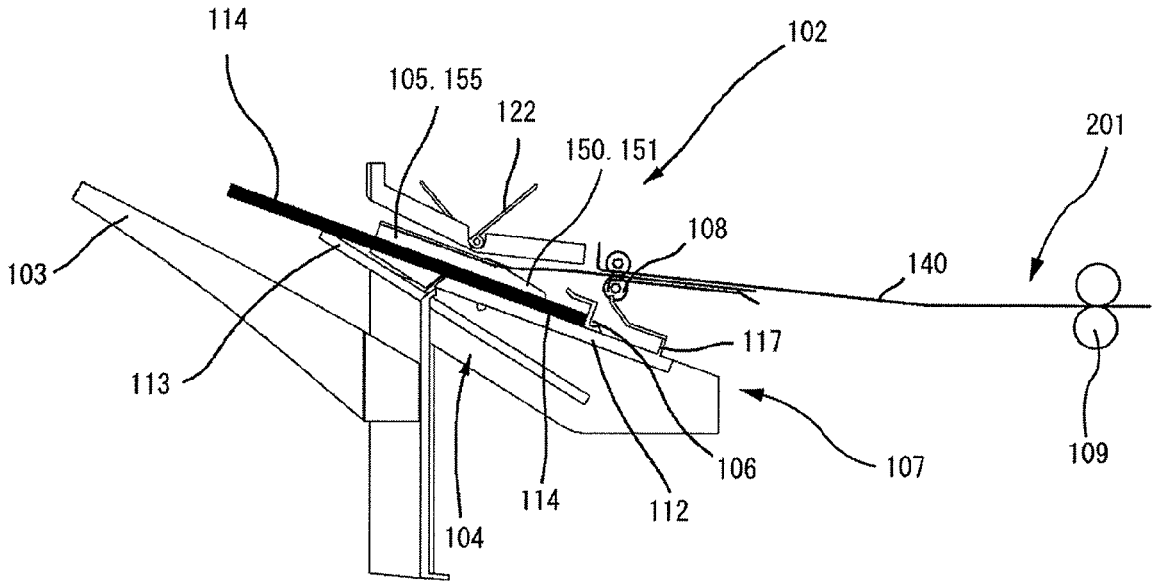
FIG. 13 is a cross-sectional view illustrating an operational procedure of the sheet post-processing device.
Figure 18:
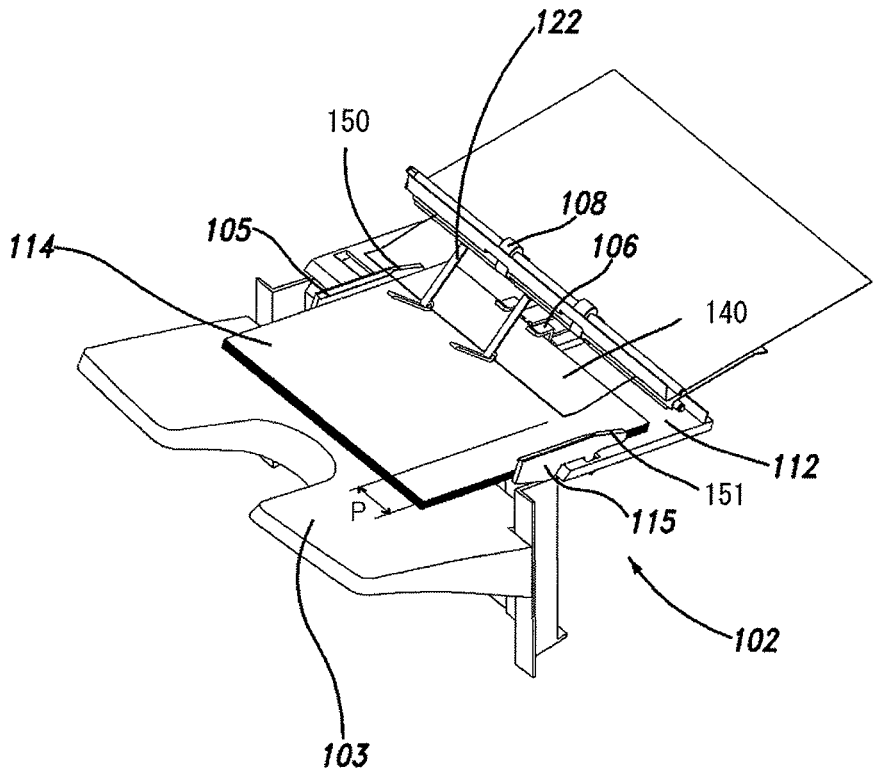
FIG. 18 is a perspective view illustrating an operational procedure of the sheet post-processing device.

After the post-processing job of the sheet bundle is accomplished, as illustrated in FIGS. 13 and 18, the ejector 106 starts to push the sheet bundle 114.

According to the present embodiment, when the subsequent sheet 14 of the sheet bundle of the next lot is conveyed immediately after a sheet bundle 114 of a single lot, the ejector is driven such that the leading end of the subsequent sheet 140 precedes the position of the ejector 106, and the trailing end can be conveyed to the area of the base tray 112 under the ejector 106 for pressedly ejecting the sheet bundle 114. In this case, in order to avoid discharge entangling of the sheet bundle 114 and separate the preceding sheet bundle 114 and the subsequent sheet 140 in the process of conveying the trailing end to the area of the base tray 112 under the ejector 106 while the leading end of the subsequent sheet 140 precedes the ejector 106, the ejector 106 is moved to guide the discharged sheet bundle 114 by locating the driving jogger 105 in the inner side of the advancing area of the subsequent sheet 140 (while the driving jogger is shifted to the fixation jogger side).

In this manner, the subsequent sheet 140 of the next lot is moved along the gradient 150 of the driving jogger 105 so that the leading end of the subsequent sheet moves to precede the ejector 106 while the driving jogger 105 is located in the inner side of the conveyance advancing area of the subsequent sheet 140. Therefore, it is possible to discharge only the sheet bundle 114 by separating the subsequent sheet 140 from the sheet bundle 114 and stably convey the subsequent sheet 140 in the area of the base tray 112 without worry about a jamming at a high speed.

Figure 14:
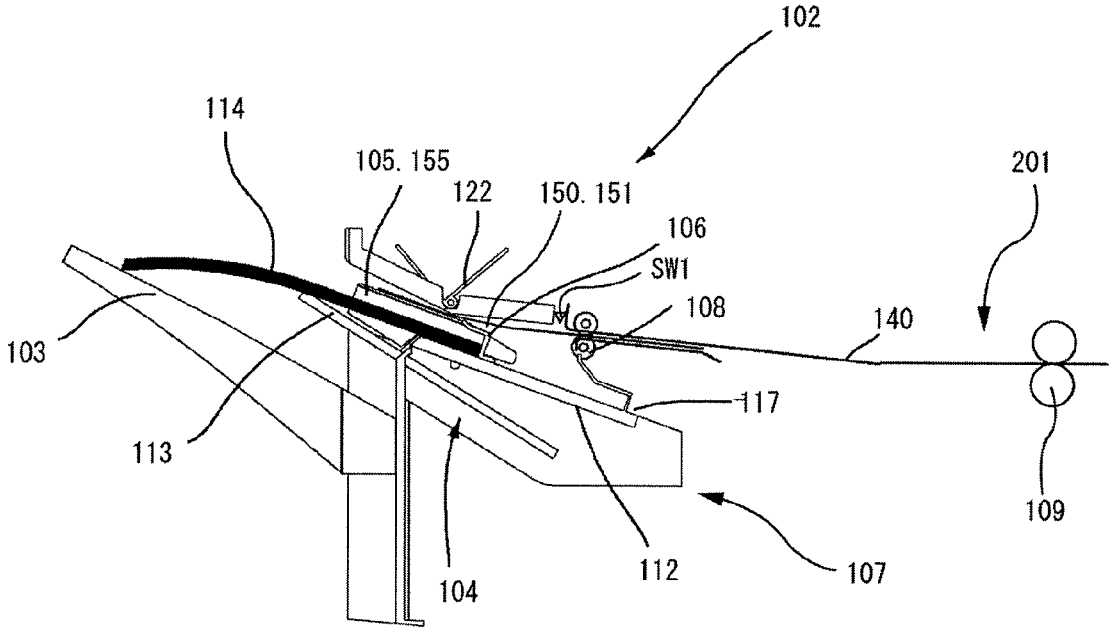
FIG. 14 is a cross-sectional view illustrating an operational procedure of the sheet post-processing device.
Figure 19:
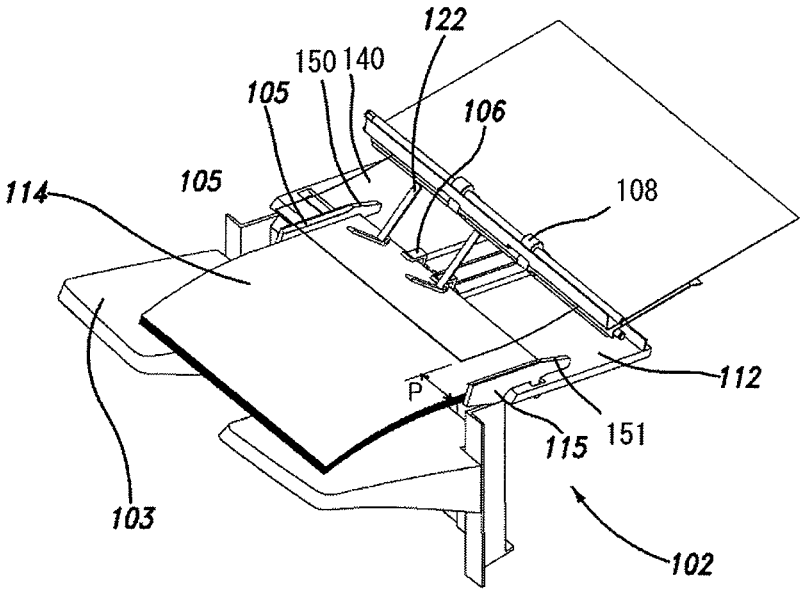
FIG. 19 is a perspective view illustrating an operational procedure of the sheet post-processing device.

FIGS. 14 and 19 illustrate a state immediately before the sheet bundle 114 is discharged on the stacker tray 103. After the sheet bundle 114 is discharged and loaded on the stacker tray 103, the ejector 106 is moved to the rear wall 117 side through the one side of the base tray 112.

Figure 15:
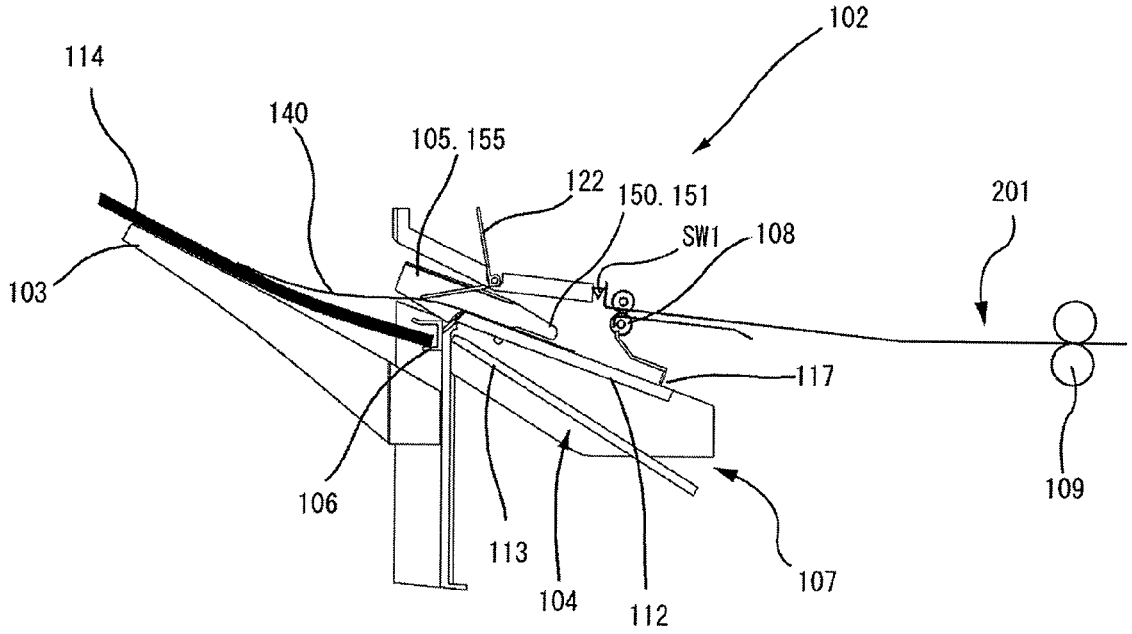
FIG. 15 is a cross-sectional view illustrating an operational procedure of the sheet post-processing device.
Figure 20:
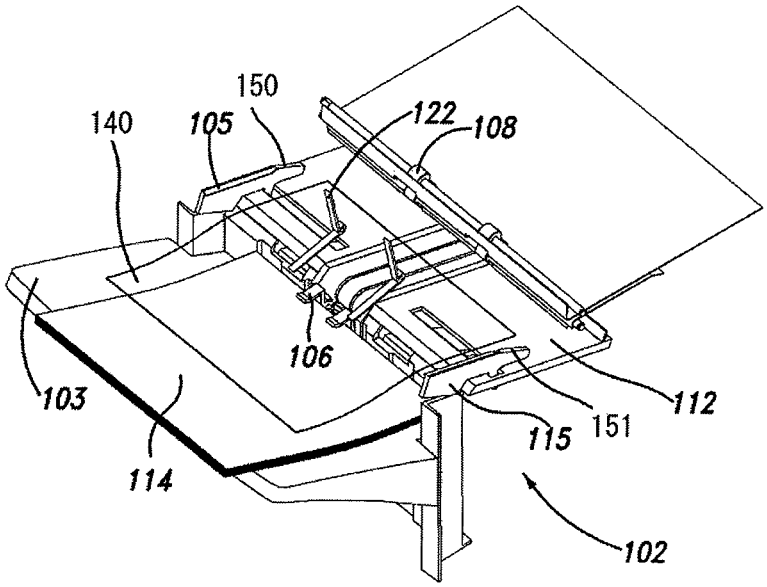
FIG. 20 is a perspective view illustrating an operational procedure of the sheet post-processing device.

As illustrated in FIGS. 15 and 20, when the sheet bundle 114 is pressedly ejected and loaded in the stacker tray 103 side, the extension tray 113 moves backward in the rear side, and the driving jogger 105 moves to the outer side of the conveyance area of the subsequent sheet 140, so that the paddle 122 is driven to prevent the subsequent sheet 140, completely discharged from the discharge roller 108, from being conveyed to the front side.

Figure 16:
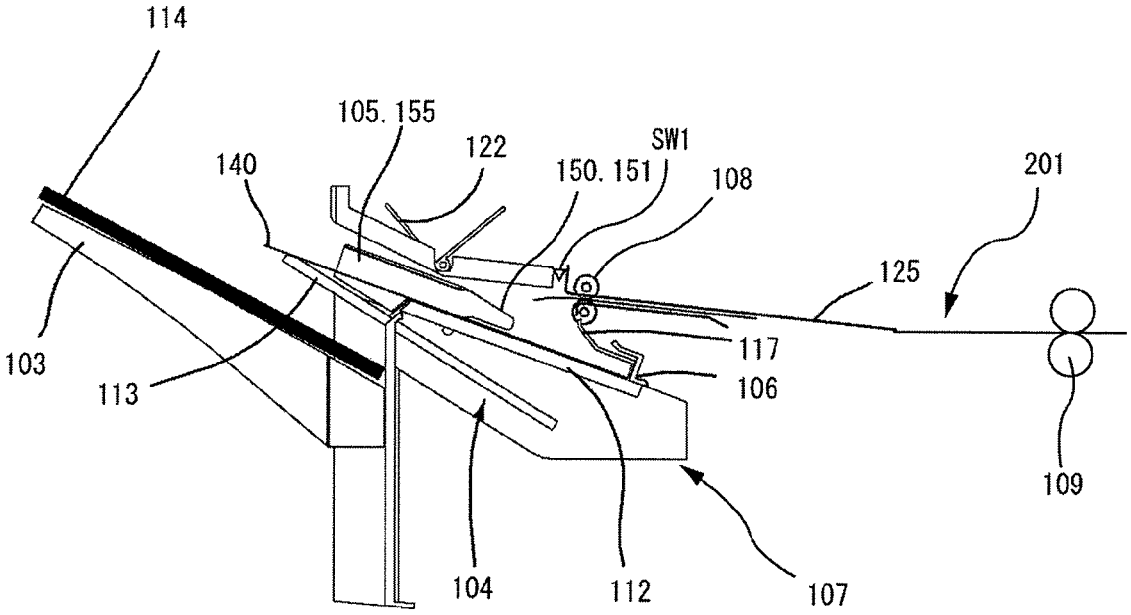
FIG. 16 is a cross-sectional view illustrating an operational procedure of the sheet post-processing device.
Figure 21:
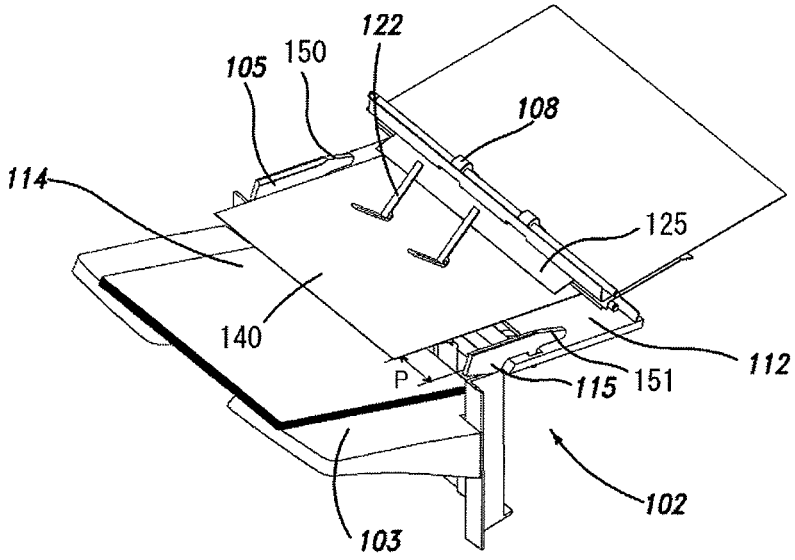
FIG. 21 is a perspective view illustrating an operational procedure of the sheet post-processing device.

By virtue of the tilt angles of the paddle 122 and the base tray 112, as illustrated in FIGS. 16 and 21, the trailing end of the subsequent sheet 140 is aligned to the rear wall 117. Before the next subsequent sheet 125 arrives at the gradient 150 of the driving jogger 105, the driving jogger 105 is driven such that the side surface of the sheet 140 is moved to a location separated at a predetermined distance P to the fixation jogger 115 side, and the subsequent sheet 140 is aligned on the base tray 112.

Meanwhile, if the subsequent sheet 140 is not conveyed, the sheet bundle 114 subjected to the sheet post-processing process is discharged on the stacker tray 103, and the loading and the job are terminated.

Figure 22:
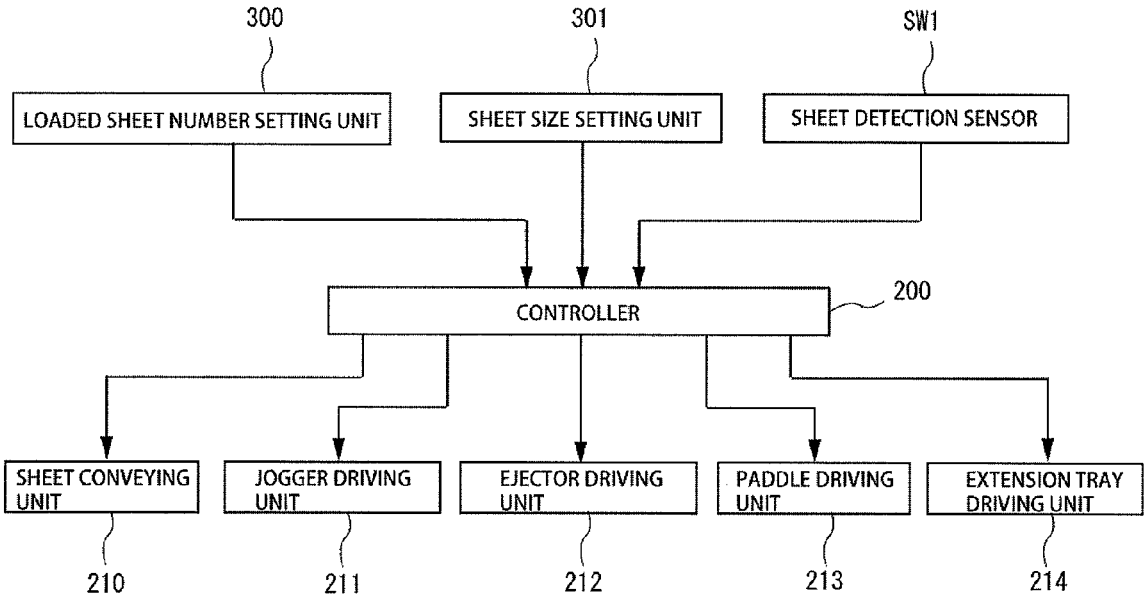
FIG. 22 is a control block diagram illustrating the sheet post-processing device.
Figure 23:
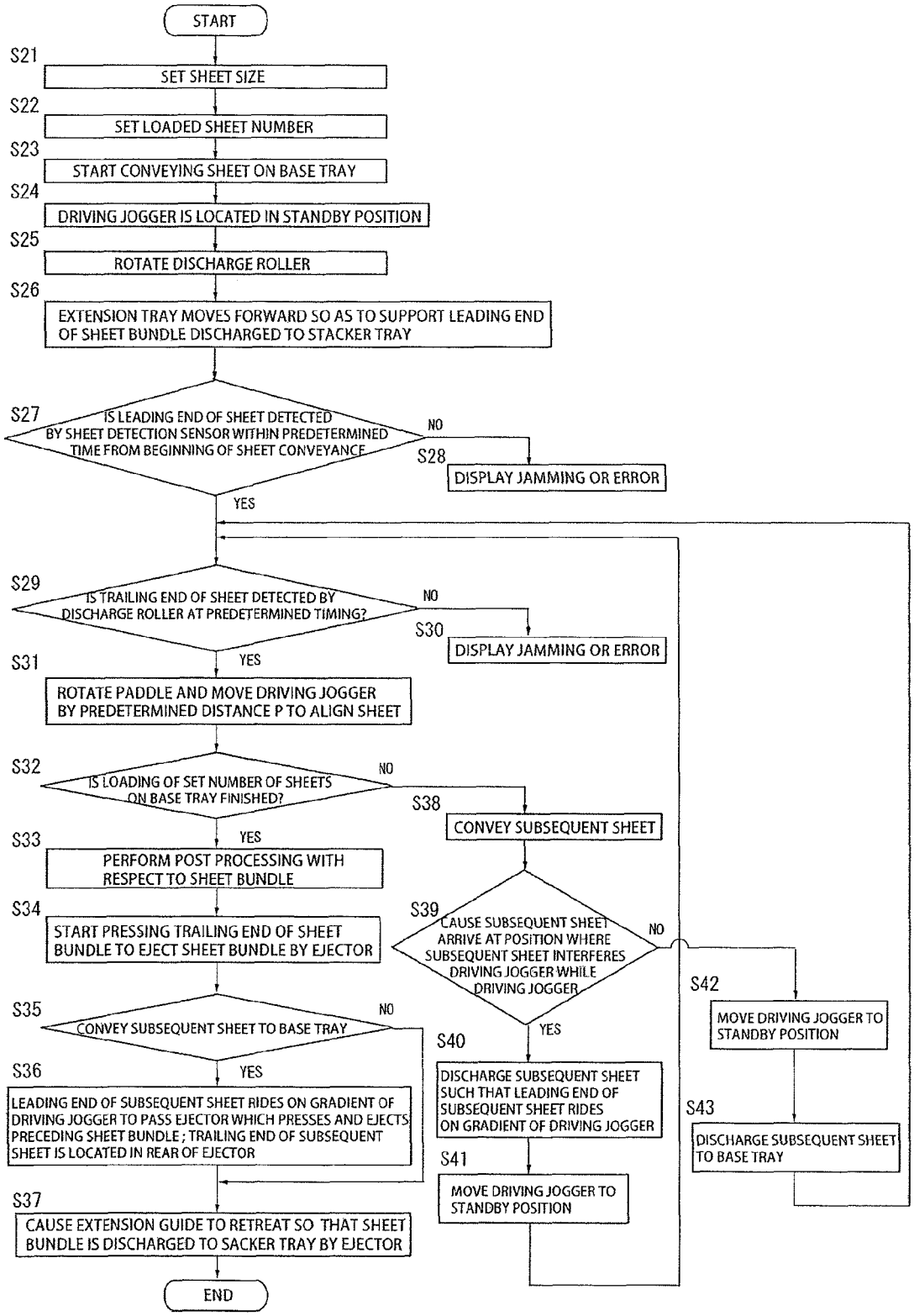
FIG. 23 is a flowchart illustrating the operation of the sheet post-processing device.
Figure 24:
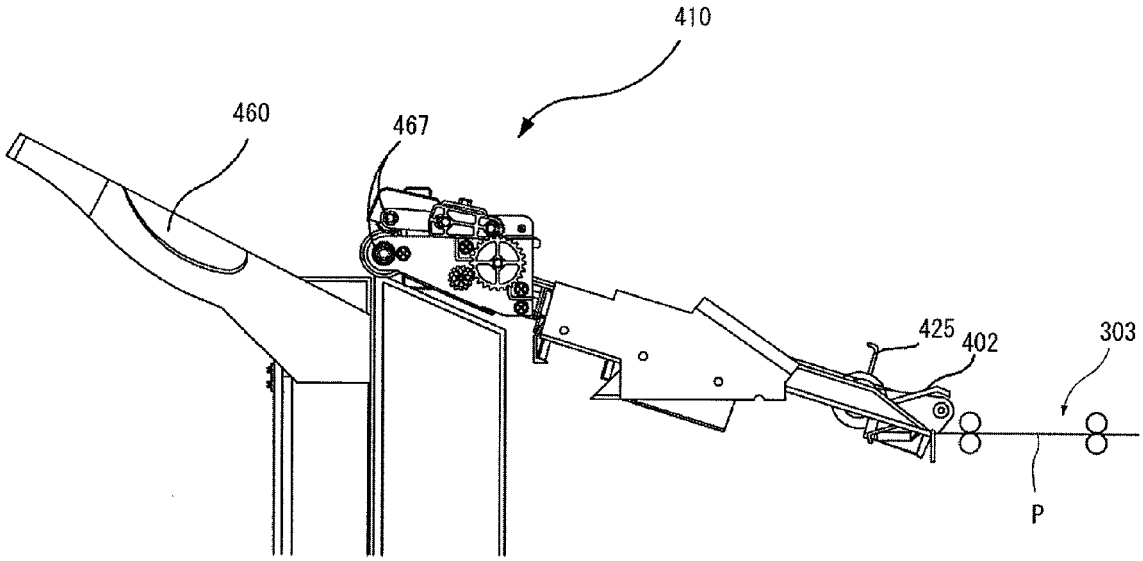
FIG. 24 is a side view illustrating a sheet discharge unit of the sheet post-processing device.
Figure 25:
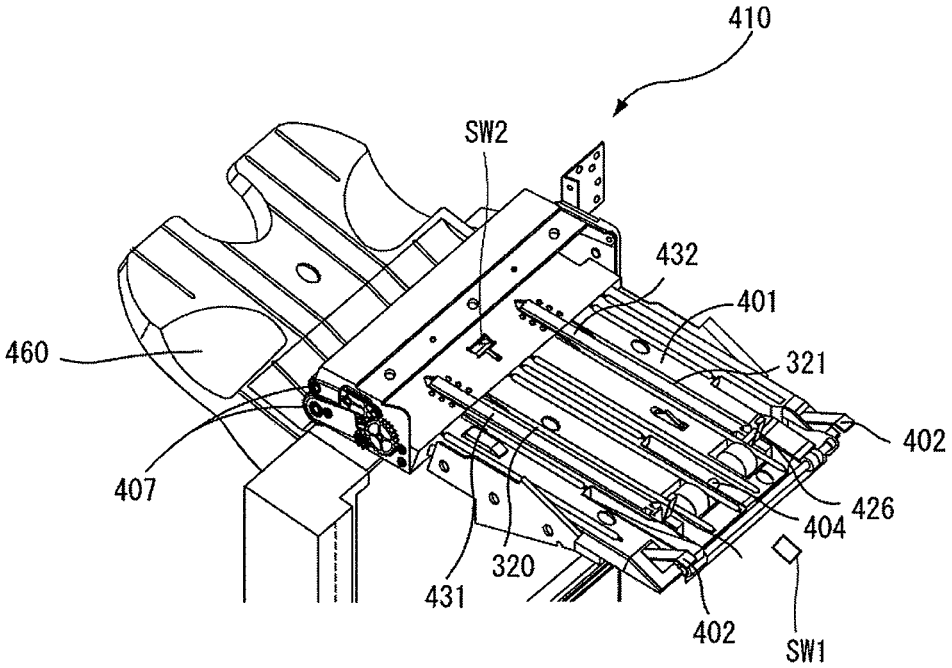
FIG. 25 is a solid diagram illustrating a sheet discharge unit of the sheet post-processing device.
Figure 26:
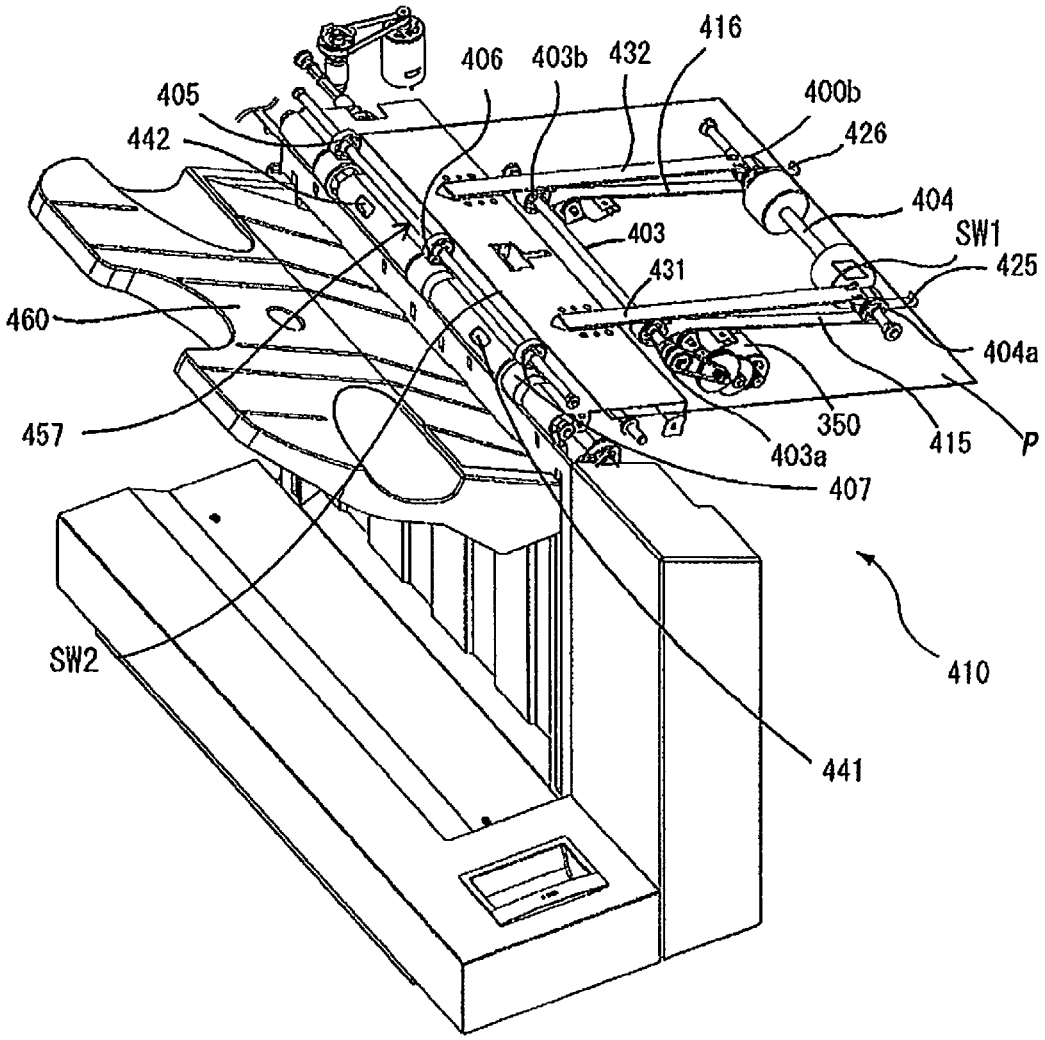
FIG. 26 is a solid diagram illustrating a state before a sheet discharge unit of the sheet post-processing device is driven.
Figure 27:
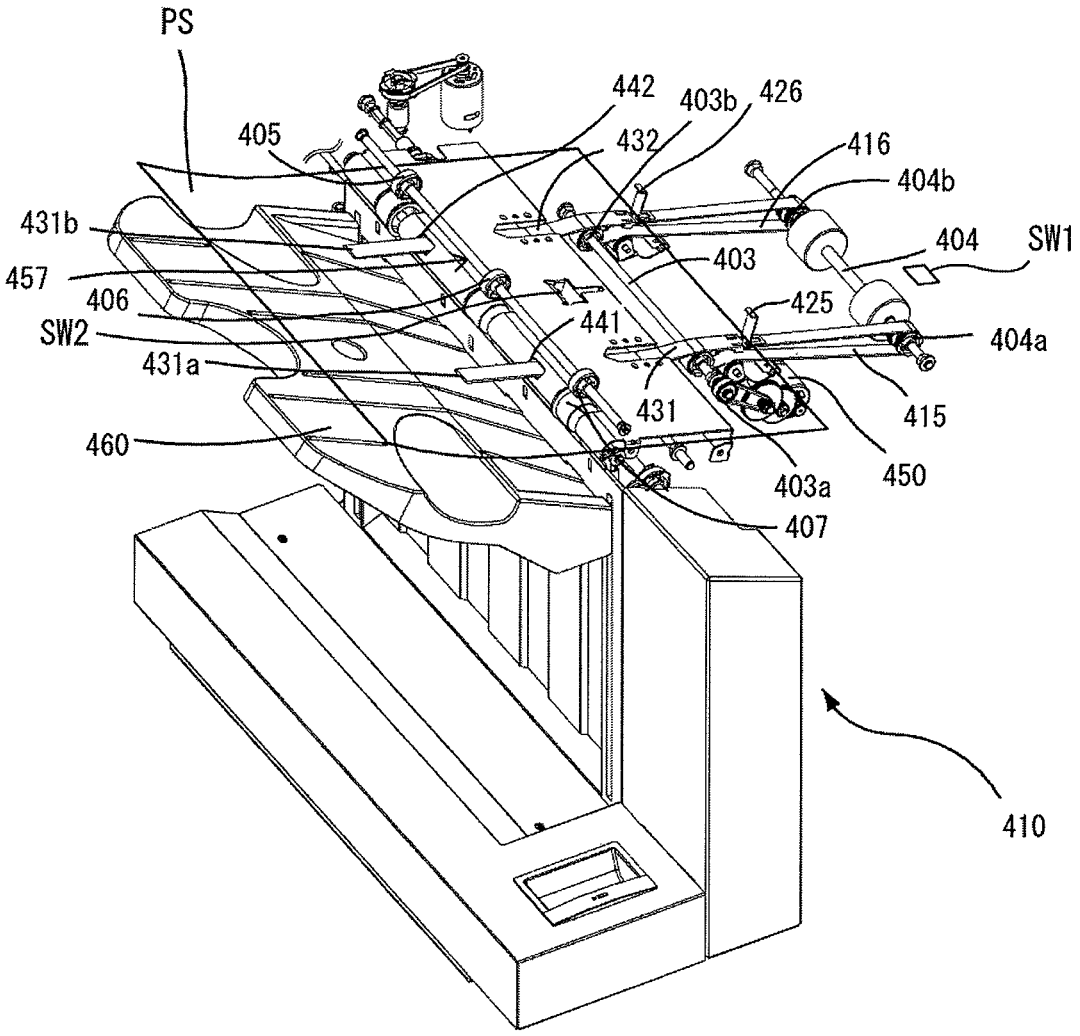
FIG. 27 is a solid diagram illustrating a state that a sheet discharge unit of the sheet post-processing device is driven.

The sheet conveyance interval, the speed, a predetermined distance P for shifting the sheet in the alignment process may be appropriately controlled and set using a control program based on the size of the sheet, the sheet detection sensor SW1, and rotation of the entrance roller 109 and the discharge roller 108, and the like. The present embodiment will be described with reference to FIGS. 22 and 23. FIG. 22 is a control block diagram illustrating the sheet post-processing device, and FIG. 23 is a flowchart illustrating the operation of the sheet post-processing device.

As illustrated in FIG. 22, the sheet post-processing device 102 includes a controller 200. The controller 200 includes a microcomputer or may be configured integrally with or separately from the controller of the image-forming apparatus 101. In addition, the sheet post-processing device 102 includes a loaded sheet number setting unit 300 for setting the number of sheets to be loaded on the base tray 122. The loaded sheet number setting unit 300 may be configured integrally with or separately from the manipulation unit of the image-forming apparatus 1. In addition, the sheet post-processing device 102 includes the sheet size setting unit 301 for setting the size of the sheet 140 conveyed from the image-forming apparatus 101. The sheet size setting unit 301 may be configured integrally with or separately from the manipulation unit of the image forming apparatus 101.

Moreover, the sheet post-processing device 102 includes a sheet conveying unit 210, a jogger driving unit 211 for driving the driving jogger 105, an ejector driving unit 212 for driving the ejector 106, a paddle driving unit 213 for driving the paddle 122, and an extension tray driving unit 214 for driving the extension tray 113. The sheet conveying unit 210 includes rollers such as the entrance roller 109 and the discharge roller 108 and conveys the sheet conveyed from the image-forming apparatus 1.

The controller 200 sets the reciprocal distance P at a predetermined position from the standby position of the driving jogger 105 in a sheet-width direction based on the width of the sheet 140 set by the sheet size setting unit 301. Although the sheet detection sensor SW1 for detecting the sheet conveyed from the image-forming apparatus 101 is located in front of the discharge roller 108, the position is not limited thereto. Although the sheet detection sensor SW1 uses a contactless sensor, a contact type sensor may be used.

The controller 200 controls the jogger driving unit 211, the ejector driving unit 212, the paddle driving unit 213, and the extension tray driving unit 214 based on detection information from the sheet detection sensor SW1 such that sheets are loaded on the base tray 122 and discharged as a sheet bundle as many as the number of sheets set by the loaded sheet number setting unit 300.

In the operation of the sheet post-processing device 102, as illustrated in FIG. 23, if the size of the sheet 140 conveyed from the image-forming apparatus 1 is set by the sheet size setting unit 301, the controller 200 sets a predetermined distance P for a reciprocal movement from the standby position of the driving jogger 105 in a sheet-width direction based on the width of the sheet 140 set by the sheet size setting unit 301 in step S21. Moreover, if the number of sheet loaded on the base tray 122 is set by the loaded sheet number setting unit 300 in step S22, the controller 200 performs control such that the sheet conveying unit 210 is driven to start an operation of conveying the sheet 140 conveyed from the image-forming apparatus 1 and aligning the sheet 140 on the base tray 112 in step S23. At the beginning of the conveyance, the driving jogger 105 is located in the standby position in step S24.

If the sheet 140 is conveyed from the image-forming apparatus 1, the conveyed sheet 140 is loaded on the compile unit 104 through the entrance roller 109 and the discharge roller 108, and the discharge roller 108 is rotated in step S25. In addition, the extension tray 113 moves forward by the extension tray driving unit 214 to support the leading end of the sheet bundle 114 discharged on the stacker tray 103 in step S26.

It is determined whether or not the sheet detection sensor SW1 detects the leading end of the sheet 140 within a predetermined time from the beginning of the conveyance by the rotation of the discharge roller 108 in step S27. If the sheet detection sensor SW does not detect the leading end of the sheet 140, a jamming or an error is indicated in step S28.

If the sheet detection sensor SW 1 detects the leading end of the sheet 140, it is determined whether or not the trailing end of the sheet 140 is detected for a predetermined time in step S29. If the trailing end of the sheet 140 is not detected, a jamming or an error is indicated in step S30. If the trailing end of the sheet 14 is detected within a predetermined time, the paddle 122 is rotated by the paddle driving unit 213, and by the jogger driving unit 211 moves the driving jogger 105 by a predetermined distance P in the sheet-width direction from the standby position to align the sheet 140 in step S31.

It determines whether or not the set number of sheet 140 is loaded on the base tray 112 (S32), if the loading is finished, the post-processing of the sheet bundle 114 is performed (S33), the ejector 106 starts to pressedly eject the trailing end of the sheet bundle 114 by the ejector driving unit 212 (S34).

In this condition, it is determined whether or not the subsequent sheet 114 is conveyed on the base tray 112 through detection of the sheet detection sensor SW1 in step S35. As the subsequent sheet 114 is conveyed on the base tray 112, the leading end of the subsequent sheet 114 rides on the gradient 50 of the driving jogger 105 to precede the ejector 106 which pressedly ejects the preceding sheet bundle 114, and the trailing end of the subsequent sheet 140 is located in rear of the ejector 106 in step S36.

The extension tray 113 retreats by the driving of the extension tray driving unit 214, and the sheet bundle 114 is discharged to the stacker tray 103 by the ejector 106 in step S37. Even when the subsequent sheet 114 is not conveyed on the base tray 112 in step S35, the extension tray 113 retreats by the driving of the extension tray driving unit 214 and is located in the standby position, and the sheet bundle 114 is discharged to the stacker tray 103 by the ejector 106 in step S37.

If the sheets 140 of the set number are not conveyed into the base tray 112 in step S32, the subsequent sheet 140 is conveyed in step S38. It is determined whether or not the subsequent sheet 140 arrives at the position where the subsequent sheet 140 interferes with the driving jogger 105 while the driving jogger 105 is located in the alignment location in step S39.

If the subsequent sheet 140 arrives at the position interfering with the driving jogger 105, the leading end of the subsequent sheet 140 moves up along the gradient 50 of the driving jogger 105, and the subsequent sheet 14 is discharged in step S40. The driving jogger 105 is moved to the standby position in step S41. If the sheet detection sensor SW1 detects the leading end of the subsequent sheet 140, the process advances to step S29 in which it is determined whether or not the trailing end of the subsequent sheet 140 is detected for a predetermined time.

If the subsequent sheet 140 does not arrive at the position interfering with the driving jogger 105 in step S39, the driving jogger 105 is moved to the standby position in step S42, and the subsequent sheet 140 is discharged to the base tray 112 in step S43. If the sheet detection sensor SW1 detects the leading end of the subsequent sheet 140, the process advances to step S29 in which it is determined whether or not the trailing end of the subsequent sheet 140 is detected within a predetermined time, and the aforementioned process is repeated.

In the present embodiment, the controller 200 performs control of the jogger driving unit 211 based on the detection information from the sheet detection sensor SW1 such that the driving jogger 105 is moved by a predetermined distance P in a sheet-width direction from the standby position while the sheets 140 are loaded on the base tray 112. The sheets 140 loaded on the base tray 112 are aligned at a position inside the surface area of the subsequent sheet 140 conveyed from the image forming apparatus 101. The subsequent sheet 140 is loaded on the surface of the driving jogger 105 while the sheets 140 are aligned by the driving jogger 105. The subsequent sheet 140 loaded on the surface of the driving jogger 105 is loaded on the base tray by moving the driving jogger 105 to the original standby position while the subsequent sheet 140 is loaded on the surface of the driving jogger 105. A reciprocal movement from the standby position of the driving jogger in a sheet-width direction by a predetermined distance is repeated. The sheets 140 on the base tray 112 are loaded by aligning the sheets as many as the set sheet number. By using operation of the driving jogger 105, it is possible to convey and load the sheet 140 at a high speed without interference between the sheet 140 on the base tray 112 and the subsequent sheet 140.

The controller 200 sets the predetermined distance P for a reciprocal movement from the standby position of the driving jogger 105 in a sheet-width direction based on the width of the sheet 140 set by the sheet size setting unit 301 so that it is possible to load and align various sizes of sheets as many as the established sheet number on the base tray 112.

As the sheet detection sensor SW1 detects the leading end of the sheet 140, and the trailing end of the sheet 140 is detected within a predetermined time, the controller 200 performs control such that the paddle 122 is rotated by the paddle driving unit 213 to make contact with the subsequent sheet 140 so that the forward conveyance of the subsequent sheet 140 is suppressed, and the end surface of the trailing end of the sheet bundle 114 is aligned. Meanwhile, the driving jogger 105 is moved by the jogger driving unit 211 by a predetermined distance P to align the sheet 140. Therefore, it is possible to reliably align the sheet bundle 114 without interfering the subsequent sheet 140 and the sheet bundle 114.

As the sheet detection sensor SW1 detects the leading end of the sheet, the controller 200 performs a control such that the extension tray 113 moves forward to support the leading end of the sheet bundle discharged on the stacker tray 103. After the sheets are aligned and loaded on the base tray 112 as many as the set sheet number, the trailing end of the sheet bundle 114 is pressed by the ejector 106. The extension tray 113 retreats to the standby position while the sheet bundle 114 is supported by the extension tray 113, and the sheet bundle 114 on the base tray 112 is discharged to the stacker tray 103. If the sheet detection sensor SW1 detects the leading end of the sheet after the sheet bundle 114 is discharged to the stacker tray 103, the extension tray 113 moves forward to support the leading end of the sheet bundle 114 discharged to the stacker tray 103 so as to achieve a compact structure. Furthermore, the extension tray 113 retreats and is located at the standby position only when the ejector 106 completes discharge of the sheet bundle 114 to the stacker try 103. Therefore, it is possible to reliably support and discharge the sheet bundle 114 to the stacker tray 103.

When the subsequent sheet 140 following the sheet bundle 114 discharged to the stacker tray 103 is conveyed on the base tray 112, the leading end of the subsequent sheet 140 rides on the driving jogger 105 and precedes the ejector 106 which pressedly ejects the preceding sheet bundle 114. The trailing end of the subsequent sheet 140 is located in rear of the ejector 106. The extension tray 113 retreats, and the sheet bundle 114 is discharged to the stacker tray 103 by the ejector 106. As a result, it is possible to smoothly discharge the sheet bundle 114 to the stacker tray 103 without interference between the subsequent sheet 140 and the ejector 106 and making the extension tray 113 interfering discharge of the sheet bundle 140 as the extension tray 113 moves backward.

Third Embodiment

In the sheet post-processing device according to the third embodiment, it is possible to stably load the bound sheet bundle on the tray and improve the binding quality.

The sheet post-processing device includes a base plate for loading the sheet conveyed from the image-forming apparatus, a tray for loading the bound sheet bundle obtained by binding the sheets of a set sheet number, an ejector for discharging the bound sheet bundle obtained by loading and binding the sheets of a set sheet number on the base plate while the bound sheet bundle is supported by an extension guide, an ejector driving unit for making a reciprocal movement of the ejector in a sheet discharge direction, a tray lifting unit for elevating the tray, a sheet detection sensor for detecting the sheet conveyed from the image-forming apparatus, a bound sheet discharge detection sensor for detecting the bound sheet bundle discharged to the tray from the base plate, a loaded sheet number setting unit for setting the number of sheets loaded on the base plate, and a control unit that performs a control such that the set number of sheets loaded on the base plate is computed based on the detection information of the sheet detection sensor, the binding is performed for the sheets of the set sheet number, the ejector driving unit is controlled to advance the ejector to discharge the bound sheet bundle to the tray and return the ejector from the advancing position to the original standby position, and the tray lifting unit is controlled based on the detection information of the bound sheet discharge detection sensor after a predetermined time to lower the tray to a position where the trailing end of the bound sheet bundle slides into the recess of the wall surface of the wall body which liftably supports the tray.

The control unit performs a control such that the set number of sheets loaded on the base plate is computed based detection information of the sheet detection sensor, the binding is performed for the sheets of the set sheet number, the ejector driving unit is controlled to advance the ejector to discharge the bound sheet bundle to the tray and return the ejector from the advancing position to the original standby position, and the tray lifting unit is controlled based on the detection information of the bound sheet discharge detection sensor after a predetermined time to lower the tray to a position where the trailing end of the bound sheet bundle slides into the recess of the wall surface of the wall body which liftably supports the tray. Therefore, it is possible to reliably load the bound sheet bundle on the tray, avoid a phenomenon that the cover of the bound sheet bundle is peeled off or bulged up, and improve the binding quality.

In addition, the sheet post-processing device includes a loading height position detection sensor for detecting the loading height of the bound sheet bundle loaded on the tray and an elastic member configured to allow the push plate to protrude through the opening in the wall body. The control unit controls the tray lifting unit to lift the tray from the position where the bound sheet bundle slides into the recess of the wall surface, and the bound sheet bundle is interposed between the push plate and tray and the push plate. The loading height position detection sensor detects the loading height of the bound sheet bundle loaded on the tray. If the set loading height is accomplished based on the detection information of the loading height of the bound sheet bundle, the control unit controls the tray lifting unit to stop the operation of loading the bound sheet bundle on the tray.

The control unit controls the tray lifting unit to lift the tray from the position where the bound sheet bundle slides into the recess of the wall surface, and the bound sheet bundle is interposed between the push plate and tray and the push plate. The loading height position detection sensor detects the loading height of the bound sheet bundle loaded on the tray. The bound sheet bundle is stably loaded on the tray based on detection information of the loading height of the bound sheet bundle. It is possible to improve the binding quality.

The sheet post-processing device includes a bound sheet bundle number setting unit for setting the number of bound sheet bundles loaded on the tray. If the operation of loading the bound sheet bundle on the tray is repeated, and the set bound sheet bundle number is accomplished based on the loading height of the bound sheet bundle, the control unit controls the tray lifting unit to stop the operation of loading the bound sheet bundle on the tray and lower the tray to a predetermined position.

If the operation of loading the bound sheet bundle on the tray is repeated, and the set bound sheet bundle number is accomplished based on the loading height of the bound sheet bundle, the tray lifting unit is controlled to stop the operation of loading the bound sheet bundle on the tray and lower the tray to a predetermined position. As a result, since the bound sheet, bundle is not interposed between the push plate and the tray, an end user can easily extract the bound sheet bundle from the tray.

The sheet post-processing device includes an adjustment unit configured to change the inclination angle of the loading surface of the tray. The inclination angle of the loading surface of the tray is changeable, and the inclination angle of the loading surface of the tray is changed depending on the number of the bound sheet bundles. Therefore, the trailing end can reliably slide into the recess of the wall surface of the wall body.

Hereinafter, the embodiment of the sheet post-processing device of the invention will be described. The embodiment of the invention describes a most preferred embodiment, and the invention is not limited to thereto. It may include the sheet buffer device according to the first embodiment.

The sheet post-processing device according to the present embodiment will be described in detail with reference to FIGS. 24 to 30. The sheet discharge unit 410 includes the base plate 410, the rear wall 2, and the sheet discharge path 457. The base plate 410 temporarily aligns the sheet P conveyed through the sheet conveyance unit 303 from the image-forming apparatus (not illustrated) such as a copy machine. The rear wall 2 is provided in rear of the base plate 401 and supports the trailing end of the sheet P aligned temporarily in the base plate 401. The sheet discharge path 457 includes a group of three discharge rollers 405, 406, and 407 provided on the upper end of the base plate 401. The sheet conveyance unit 303 includes, for example, a roller or the like.

Rotational axes 403 and 404 are provided in the rear of the sheet discharge path 457 including a group of discharge rollers 405, 406, and 407. Pulleys 403A and 403B are provided at both ends of the rotational axis 403, and pulleys 404A and 404B are provided at both ends of the rotational axis 404. The belt 415 and 416 are stretched between pulleys 403A and 404A and pulleys 403B and 404B, respectively. The faces of each belt 415 and 416 are generally maintained in parallel with the face of the base plate 401. Ejectors 425 and 426 are provided in the face of each belt 415 and 416, and notch holes 320 and 321 are provided in the base plate 401 so as to move the ejectors 425 and 426 to the base plate 401 side.

Meanwhile, one end of the extension guides 431 and 432 having a band shape formed of a plastic or rubber material is fixed to the belts 415 and 416. The other end of the extension guides 431 and 432 is inserted into the guide holes 441 and 442, respectively, provided under the sheet discharge path 457 to move backwardly generally in parallel with the base plate 401.

The extension guides 431 and 432 are configured to work with the ejectors 425 and 426, respectively, by rotating the belts 415 and 416 by virtue of the forward/reverse rotation of the ejector driving unit 304 for driving the rotational axis 3, that is, the driving motor 450.

The tray 460 for loading the bound sheet bundle PS obtained by binding the set number of sheets is provided in the front lower part of the sheet discharge path 457 including a group of three discharge rollers 405, 406, and 407. As the sheet P is conveyed from the image forming apparatus (not illustrated) while the ejectors 425 and 426 are located in the standby position, the sheet discharge unit 410 waits in an aligned state while the trailing end of the sheet P is supported by the rear wall 2.

The sheet P is aligned to the rear wall 402, and the sheets P are loaded and aligned to the rear wall 402 as much as the set number of sheets. Then, the sheets P are bound using the binding device (not illustrated). The bound sheet bundle PS may be conveyed to the sheet discharge path 457 by the ejectors 425 and 426.

As the trailing end presses the bound sheet bundle PS by the ejectors 425 and 426, and the leading end of the bound sheet bundle PS is conveyed to the sheet discharge path 457 formed by the group of discharge rollers 405, 406, and 407, the bound sheet bundle PS is smoothly conveyed to the tray 460 side by virtue of the rolling operation of the group of discharge rollers 405, 406, and 407.

In the process of conveying the bound sheet bundle PS using the ejectors 425 and 426, the extension guides 431 and 432 moves in synchronization with the ejectors 425 and 426. The leading end (the other ends 431*a* and 432*a*) of the extension guides 431 and 432 inserted into the guide holes 441 and 442 protrudes to the downside of the sheet discharge unit 410 including the group of discharge rollers 405, 406, and 407 to support one surface of the bound sheet bundle PS.

If the leading end of the bound sheet bundle PS of which one surface is supported by the leading end 431*a* and 432*a* of the extension guides 431 and 432 is safely seated on the tray 460, the extension guides 431 and 432 and the ejectors 425 and 426 are moved to the original location by virtue of the reverse driving of the driving motor 350.

Figure 28:
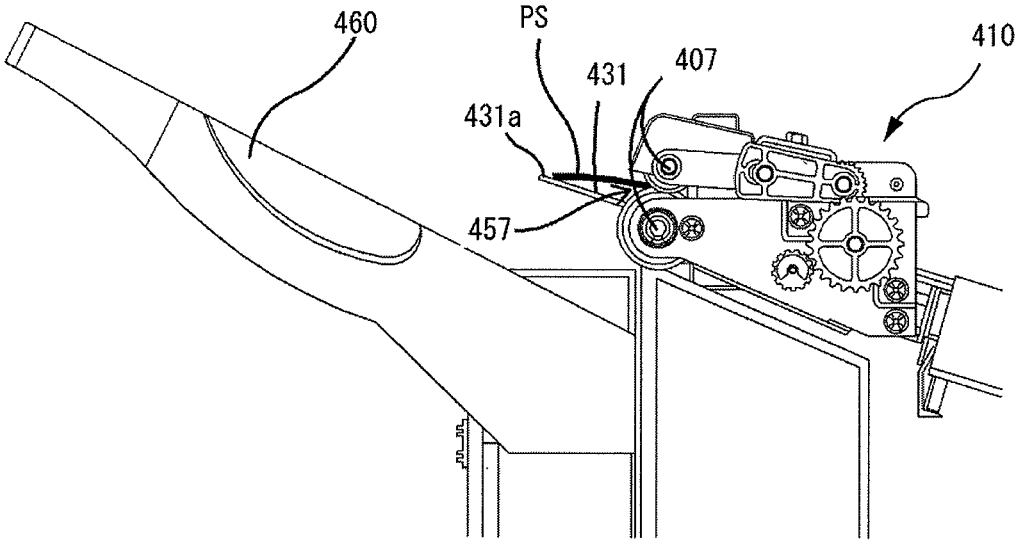
FIG. 28 is a side view illustrating an operational procedure of a sheet discharge unit of the sheet post-processing device.

The operational process of the sheet discharge unit 410 configured in such a manner will be described with reference to FIGS. 28 to 30. As illustrated in FIG. 28, if the bound sheet bundle PS starts to be discharged through the sheet discharge path 457 including the discharge roller pairs 405, 406, and 407, the leading ends 431A and 432A of the extension guides 431 and 432 protrude by a certain length position to the tray 460 side.

Figure 29:
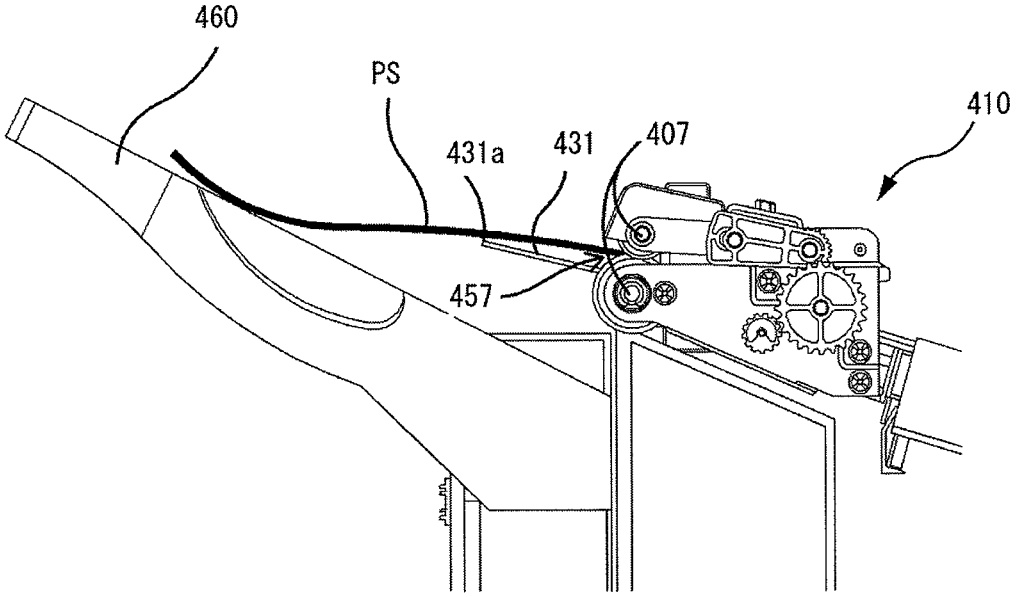
FIG. 29 is a side view illustrating an operational procedure of a sheet discharge unit of the sheet post-processing device.
Figure 30:
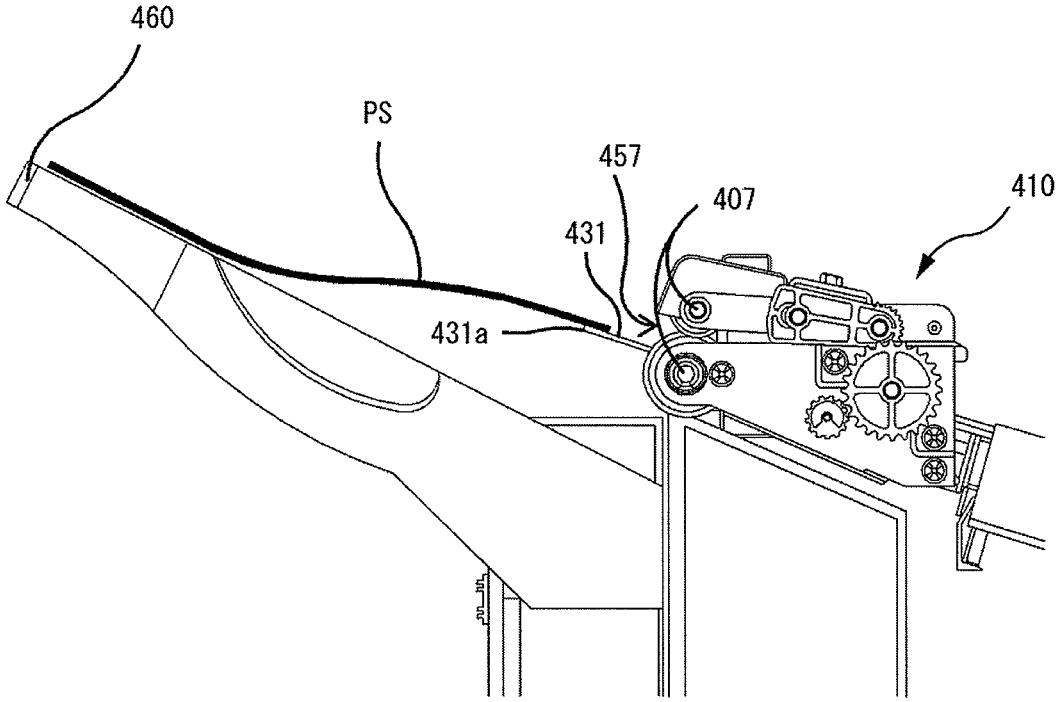
FIG. 30 is a side view illustrating an operational procedure of a sheet discharge unit of the sheet post-processing device.
Figure 31:
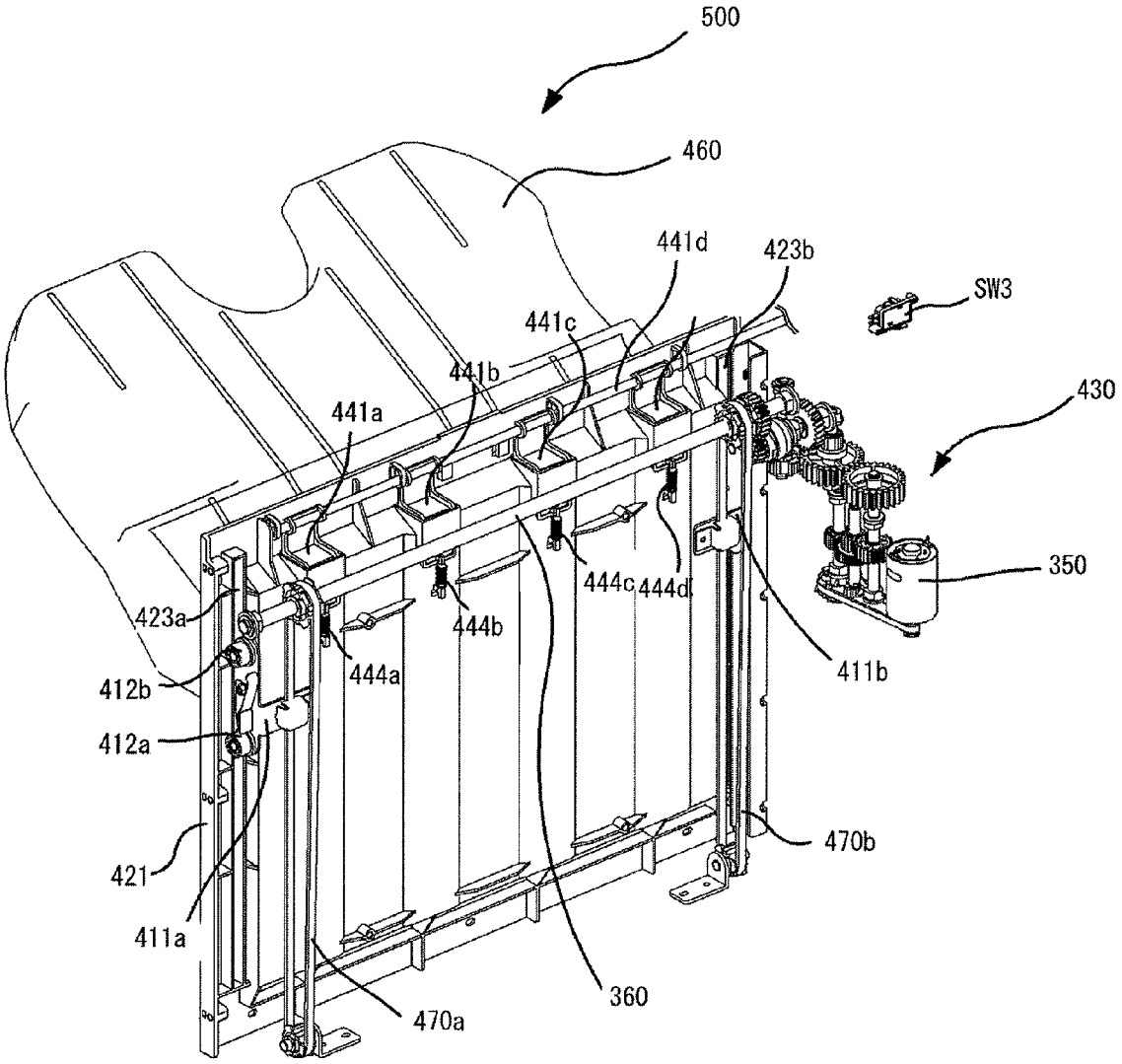
FIG. 31 is a solid diagram illustrating the inner side of the sheet post-processing device.
Figure 32:
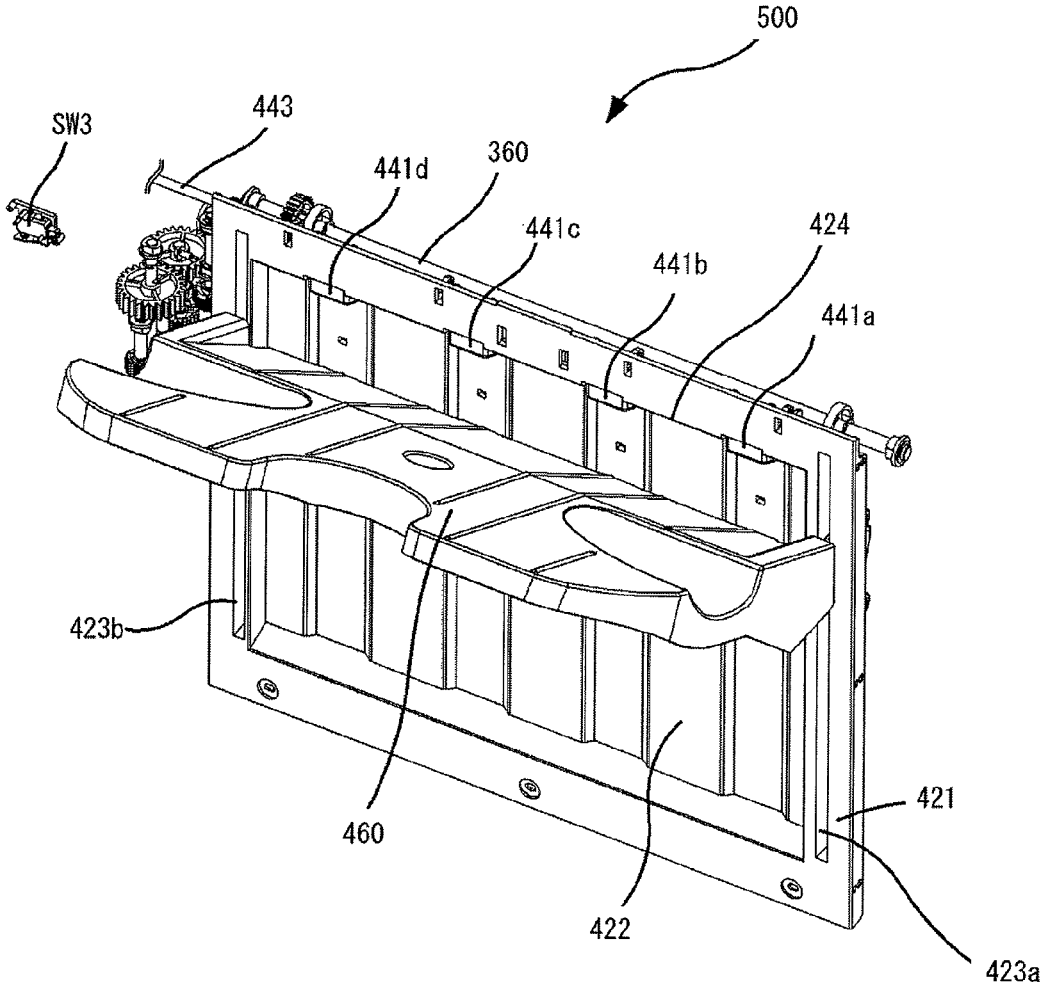
FIG. 32 is a solid diagram illustrating the sheet post-processing device of FIG. 26 as seen from the rear side.
Figure 33:
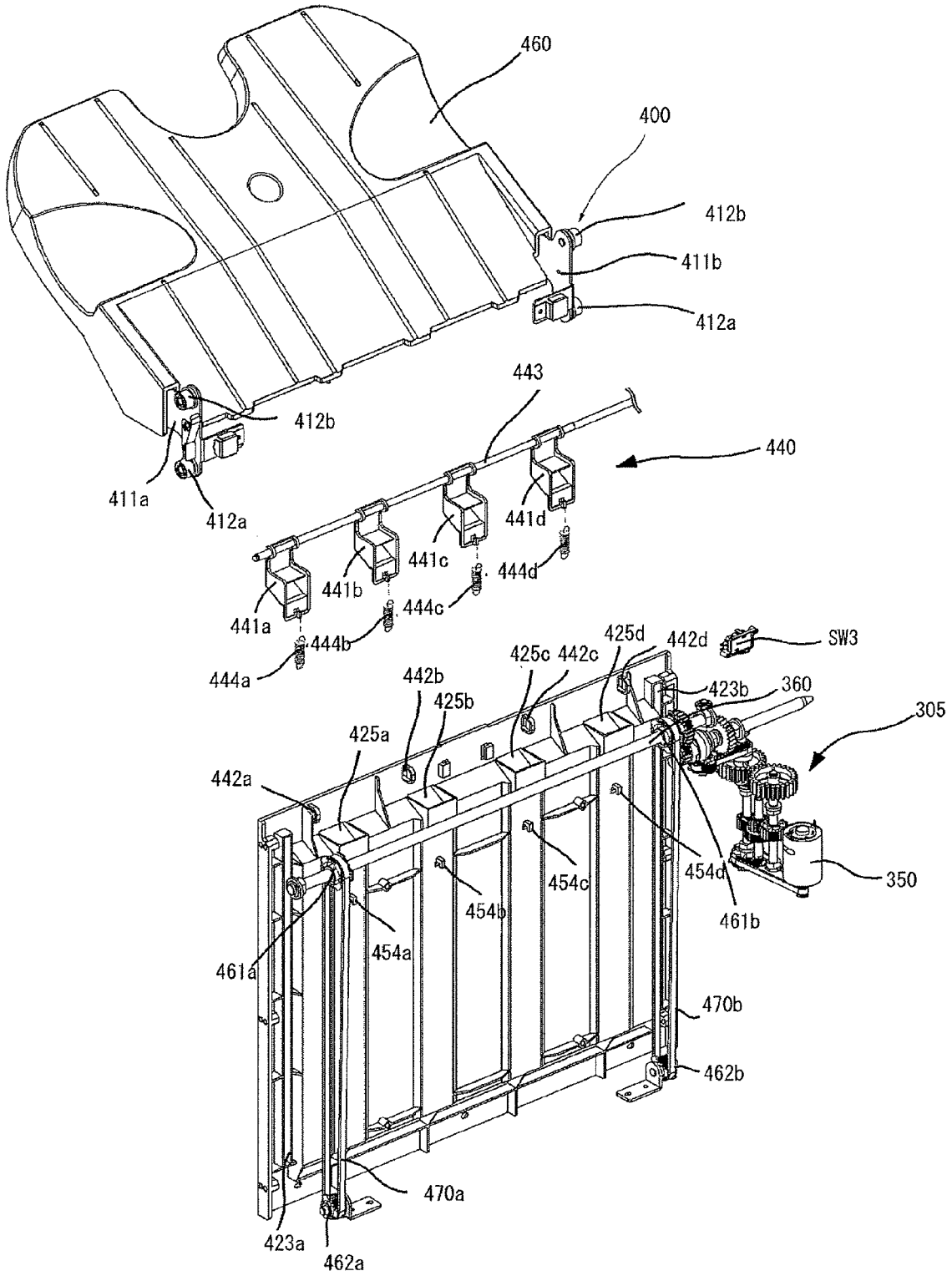
FIG. 33 is an exploded perspective view of the sheet post-processing device.

As illustrated in FIG. 29, the leading ends 431*a* and 432*a* of the extension guides 431 and 432 are maintained in a state that one surface of the bound sheet bundle PS is supported until the leading end of the bound sheet bundle PS is safely seated on the tray 460. Therefore, the leading end of the bound sheet bundle PS is not blocked on the tray 460. After the leading end of the bound sheet bundle PS is safely seated on the tray 460, the leading ends 431*a* and 432*a* of the extension guides 431 and 432 move to the original position as illustrated in FIG. 30.

The sheet discharge unit 410 fixes one end of the extension guides 431 and 432 in the belt surfaces 415 and 416 where the ejectors 425 and 426 are fixed in parallel to the moving direction of the belt 415 and 416 surfaces. The other ends of the extension guides 431 and 432 are configured to be inserted into the guide holes 441 and 442, respectively, formed on the lower end of the sheet discharge path. Therefore, the leading end of the bound sheet bundle PS can be safely seated on the loading surface of the tray 460 using the extension guides 431 and 432 which uses the power of the driving motor 450 of the ejectors 425 and 426 without a separate driving device.

In addition, it is possible to prevent the inappropriate loading of the bound sheet bundle PS or sheet rolling in the process of loading the bound sheet bundle PS on the loading surface of the tray 460.

In this manner, according to the present embodiment, the sheet discharge unit 410 includes the group of discharge rollers 405, 406, and 407, two rotational axes 403 and 404 provided in parallel with the center axis direction of a group of discharge rollers 405, 406, and 407 in the rear of a group of discharge rollers 405, 406, and 407, the belts 415 and 416 stretching between two rotational axes 403 and 404, the driving motor 450 for driving any one of the rotational axes 403 and 404 to rotate forward/backward, the ejectors 425 and 426 fixed to the belts 415 and 416 so as to push and convey the trailing end of the bound sheet bundle PS to a group of discharge rollers 405, 406, and 406, and extension guides 431 and 432 of which one end is fixed to the belts 415 and 416 and the other end is inserted into the guide holes 441 and 442 provided under the group of discharge rollers 405, 406, and 407. When the ejectors 425 and 426 move to a group of discharge rollers 405, 406, and 407 side by moving rotatably belts 415 and 416 using the driving motor 405, the other end of the extension guides 431 and 432 may protrude to the outer side of a group of discharge rollers 405, 406, and 407 through the guide holes 441 and 442. The other end of the extension guides 431 and 432 protruding to the outer side of a group of discharge rollers 405, 406, and 407 supports one surface of the bound sheet bundle PS discharged through a group of discharge rollers 405, 406, and 407.

Next, the technical configuration and operation of the binding sheet loading device will be described in detail with reference to FIGS. 31 to 44. The sheet loading device 500 of the invention includes a wall body 421 made of a plastic or metal material and a recess 422 formed on the wall body 421. Both surfaces of the recess 422 are provided with slits 423*a* and 423*b* in the longitudinal direction, and the upper end 424 of the wall body 421 having the recess 422 is provided with openings 425*a*, 425*b*, 425*c*, and 425*d*.

The elastic member 440 is provided in the rear surface of the wall body 421 so that the push plates 441*a*, 441*b*, 4441*c*, and 441*d* protrude through the openings 425*a*, 425*b*, 425*c*, and 425*d*, respectively. The elastic member 440 includes the push plates 441*a*, 441*b*, 441*c*, and 441*d* configured to protrude to the recess 422 side through the openings 425*a*, 425*b*, 425*c*, and 425*d*, respectively, shaft fixing latches 442*a*, 442*b*, 442*c* and 442*d* provided in the rear surface of the wall body 421, the shaft 443 flexibly inserted into the shaft fixing latches 442*a*, 442*b*, 442*c* and 442*d* while a part of the push plates 441*a*, 441*b*, 441*c*, and 441*d* is fixed, and springs 444*a*, 444*b*, 444*c*, and 444*d* provided between the other end of each push plates 441*a*, 441*b*, 441*c*, and 441*d* and spring fixing latches 445*a*, 445*b*, 445*c*, and 445*d*, respectively, formed on the rear surface of the wall body 421 to elastically press and pull down each push plates 441*a*, 441*b*, 441*c*, and 441*d*.

Meanwhile, the tray lifting unit 305 is provided in the rear surface of the wall body 421 having the recess 422. The tray lifting unit 305 includes the belt driving axis 360 driven by the driving motor 350, the driving pulleys 461*a* and 461*b* provided at both sides of the belt driving axis 360, the following pulleys 462*a* and 462*b* provided in each corresponding position to the driving pulleys 461*a* and 461*b* separated from the driving pulleys 461*a* and 461*b* at a predetermined distance, and the belts 470*a* and 470*b* stretching between each driving pulley 461*a* and 461*b* and the following pulleys 462*a* and 462*b* so as to be arranged straightly parallel with the slits 423*a* and 423*b* of the wall body.

The locking units 411*a* and 411*b* of the tray 460 are inserted into slits 423*a* and 423*b*, respectively. The locking units 411*a* and 411*b* are fixed to each belt 470*a* and 470*b* so that the tray 460 can be vertically lifted and lowered according to the slits 423*a* and 423*b* by virtue of rotation of the belts 470*a* and 470*b*.

Figure 45:
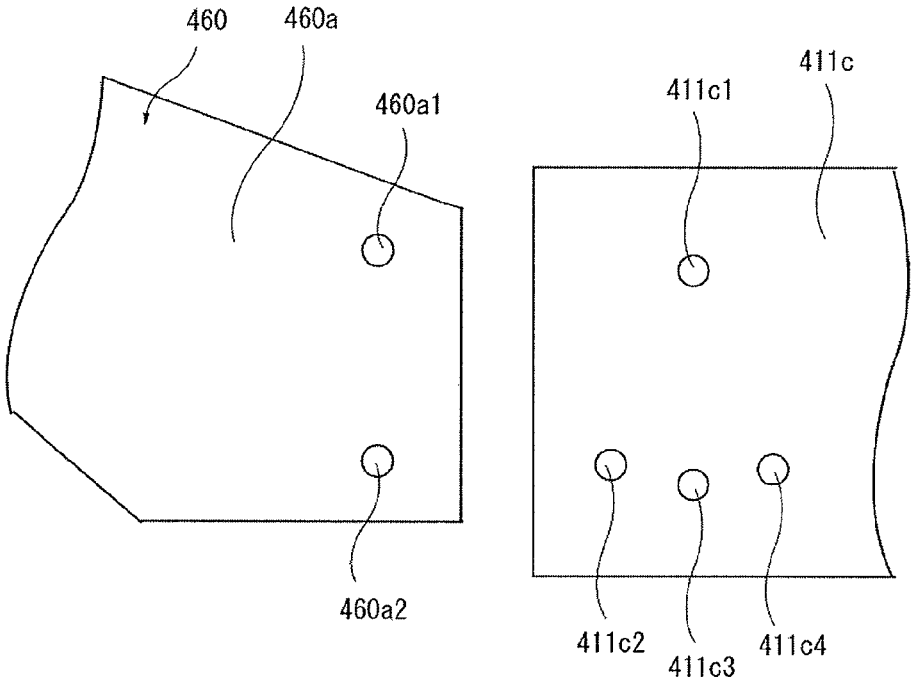
FIG. 45 is a diagram illustrating an example of an adjusting unit which allows for change of a tilt angle of the loading surface of the tray.
Figure 45:
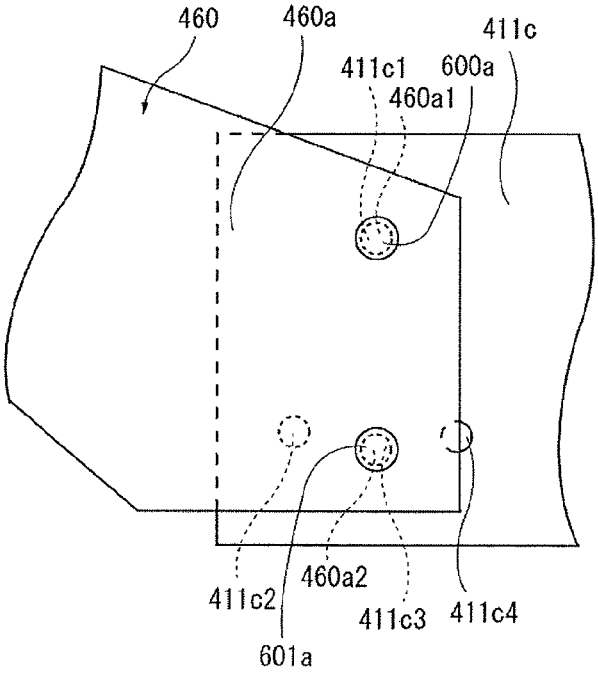

In order to allow the bound sheet bundle PS conveyed on the tray 460 to slide down to the body wall 421 by its own weight and arrive at a tape part PS1 of the bound sheet bundle PS at the body wall surface, the tray 460 has an inclination of 25° to 45°. The locking units 411*a* and 411*b* of the tray 460 are provided with rollers 412*a* and 412*b*, respectively, making contact with a rear surface of the wall body 421 provided to reduce a lifting friction. The tray 460 can change the inclination of the loading surface. The adjustment unit 400 capable of changing the inclination of the loading surface of the tray 460 is configured, for example, as illustrated in FIG. 45, so that the inclination of the loading surface of the tray 460 can be changed. Therefore, it is possible to allow the trailing end to reliably slide into the recess 422 of the wall surface of the wall body 21 depending on the number of bound sheet bundles PS or the like.

An exemplary adjustment unit 400 for enabling the change of the inclination of the loading surface of the tray 460 will be described with reference to FIG. 45. The mounting holes 460*a*1 and 460*a*2 are formed on a pair of base portions of the tray 460 vertically separated from each other at a predetermined distance. In a pair of locking units 411*c*, the mounting hole 411*c*1 is formed in an upper position, and the mounting holes 411*c*2, 411*c*3, and 411*c*4 are formed in an lower position along an arc extending from the upward mounting hole 411*c*1 as a fulcrum point. The mounting hole 460*a*1 of a pair of base portions 460*a* of the tray 460 is connected to the upward mounting hole 411*c*1 of a pair of locking units 411*c* using a pair of pins 600*a*. The mounting hole 460*a*1 of a pair of base portions 460*a* is connected to the mounting hole 411*c*2 selected from the upward mounting holes 411*c*2, 411*c*3, and 411*c*4 of a pair of locking units 411*c* using a pair of pins 600*b*. It is possible to change the inclination of the loading surface of the tray 460 by selecting any one of the upward mounting holes 411*c*2, 411*c*3, and 411*c*4. In this manner, it is possible to maintain the inclination of the tray 460 within 25° to 45°. It is possible to reliably slide the trailing end into the recess 22 of the wall surface of the wall body 421 by changing the inclination of the loading surface of the tray 460 depending on the number of the bound sheet bundles PS or the like.

A loading height position detection sensor SW3 is provided to detect the height of the bound sheet bundle PS loaded on the tray 460 and stop lifting of the tray 460 at the position where the loaded bound sheet bundle PS is pressed by the push plates 441*a*, 441*b*, 441*c*, and 441*d*. The loading height position detection sensor SW3 is provided in the upper end step portion 424 or the side portion of the wall body 421 so as to detect a position slightly higher than the end position of the push plates 441*a*, 441*b*, 441*c*, and 441*d* protruding to the openings 425*a*, 425*b*, 425*c*, and 425*d* of the wall body 421 using a limit switch and the like.

Figure 34:
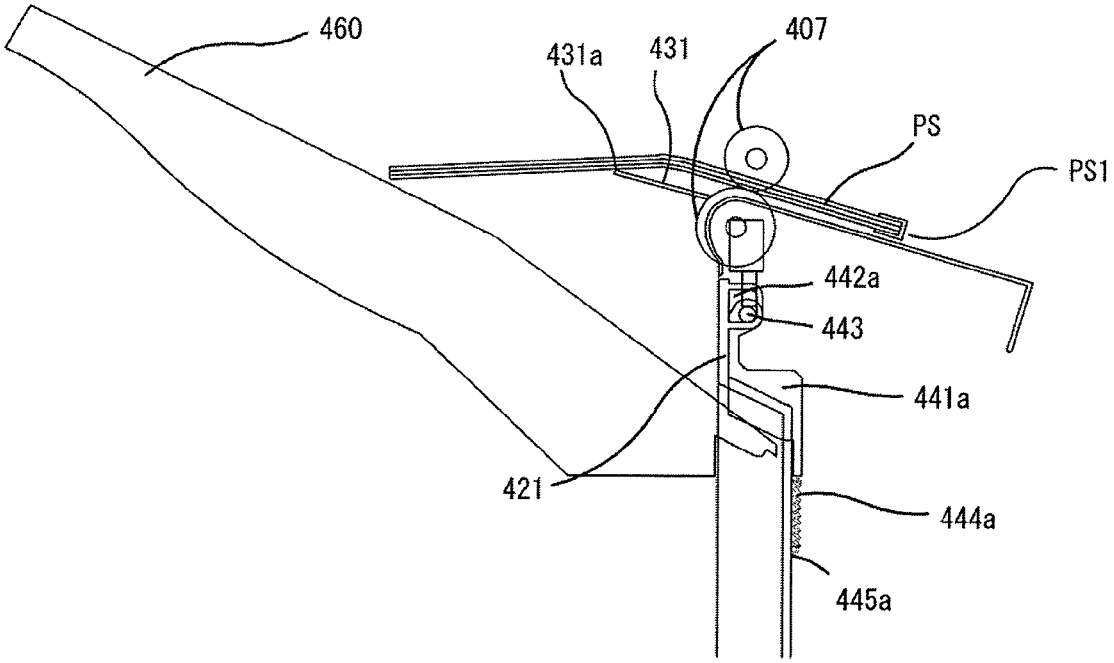
FIG. 34 is a cross-sectional view illustrating an operational procedure of the sheet post-processing device.

The operational process of the sheet loading device 500 configured in such a manner will be described in detail with reference to FIGS. 34 to 43. First, the bound sheet bundle PS subjected to the binding is discharged to the tray 460 from the binding device (not illustrated) provided in the sheet post-processing unit such as an image-forming apparatus through the roller 406 (FIG. 34). When the bound sheet bundle PS is discharged through the roller 406 to the tray 460, the leading end of the bound sheet bundle PS is safely seated on the loading surface of the tray 460 while the bound sheet bundle PS is supported by the extension guides 431 and 432.

Figure 35:
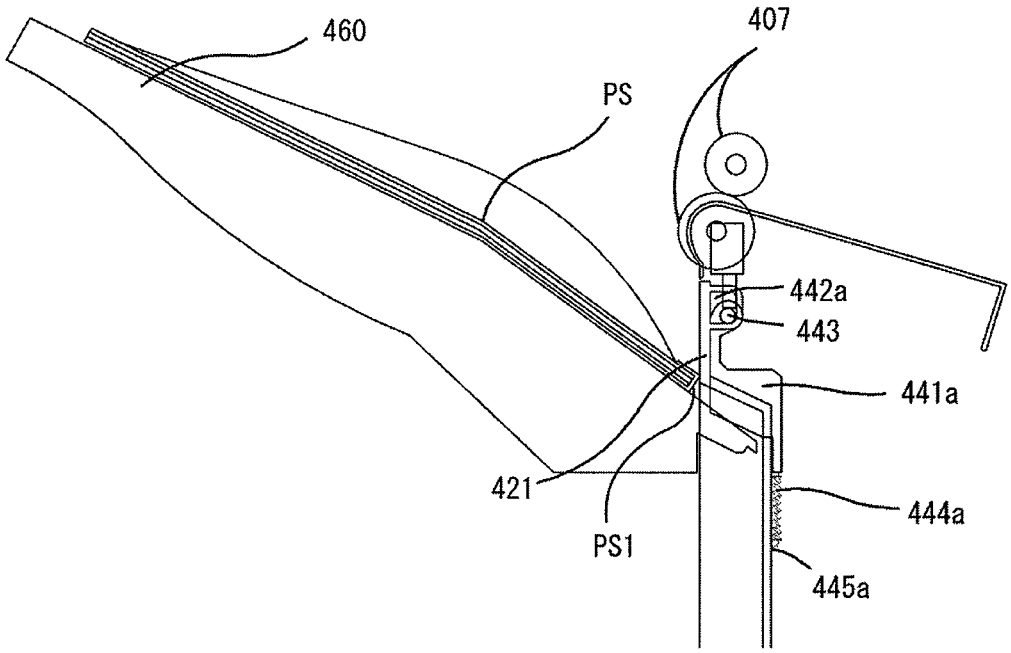
FIG. 35 is a cross-sectional view illustrating an operational procedure of the sheet post-processing device.

In this manner, if the leading end of the bound sheet bundle PS, of which one surface is supported by the leading ends 431*a* and 432*a* of the extension guides 431 and 432, is safely seated on the tray 460, the extension guides 431 and 432, and the ejectors 425 and 426 are moved to the original position by reversely driving the driving motor 350. If the bound sheet bundle PS discharged to the tray 460 slides down to the wall body 421 side of the loading device of the sheet post-processing device by its own weight as illustrated in FIG. 35, the tray 460 is lowered by a predetermined interval to allow a portion of the end of the bound sheet bundle PS where a tape PS1 of is attached to slide down from the recess 422 formed on the wall body 421 as illustrated in FIG. 36.

The descending timing of the tray 460 may be set such that the tray 460 is lowered by a certain spatial interval and a certain time interval depending on the discharge signal of the bound sheet bundle PS taking into account the discharging time of the bound sheet bundle PS. The descending time of the tray 460 may be set such that the tray 460 is lowered by a certain interval by detecting that the bound sheet bundle PS is conveyed to the tray 460.

Figure 36:
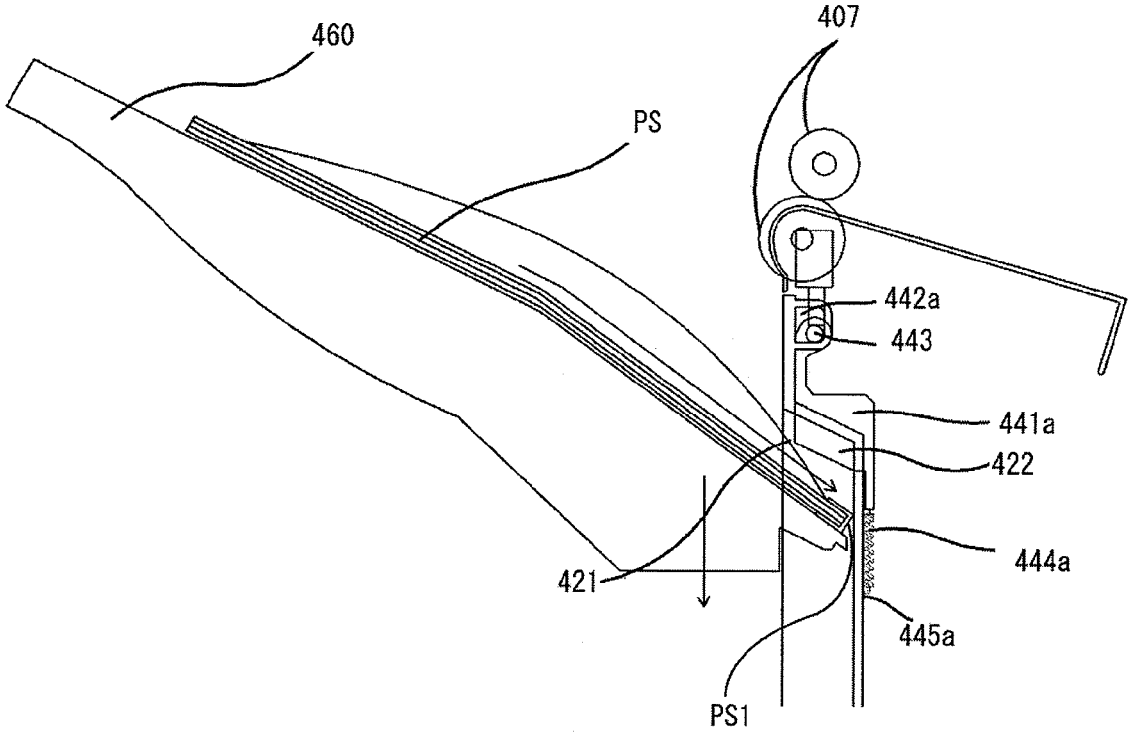
FIG. 36 is a cross-sectional view illustrating an operational procedure of the sheet post-processing device.
Figure 37:
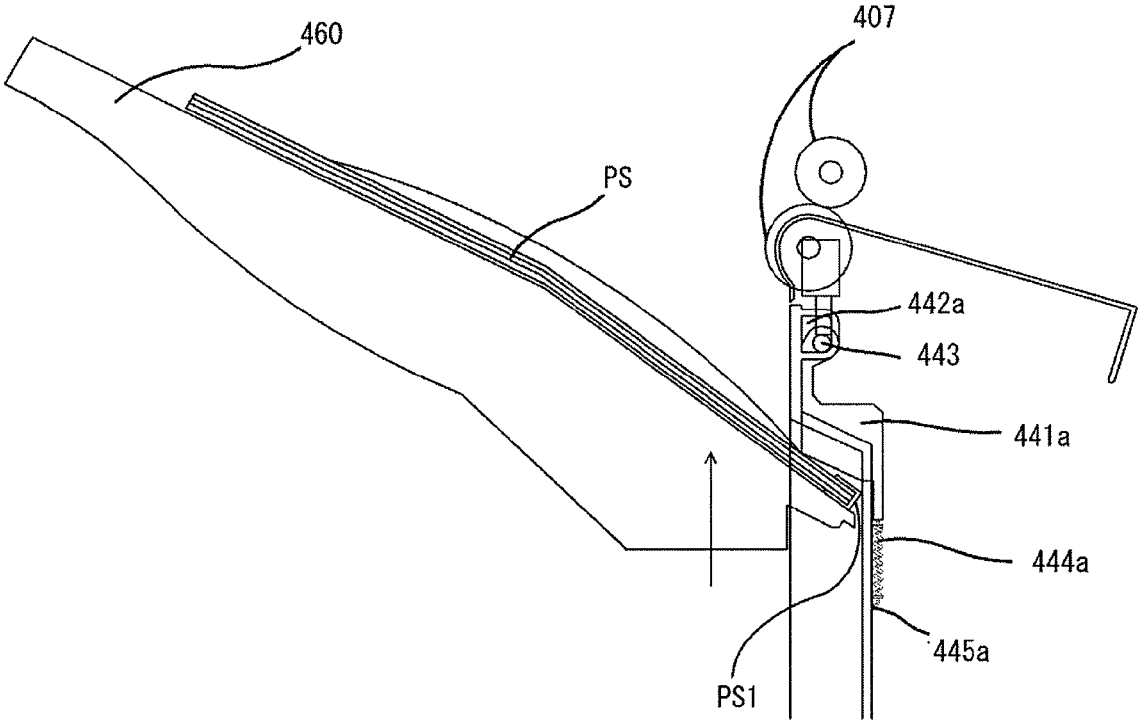
FIG. 37 is a cross-sectional view illustrating an operational procedure of the sheet post-processing device.
Figure 38:
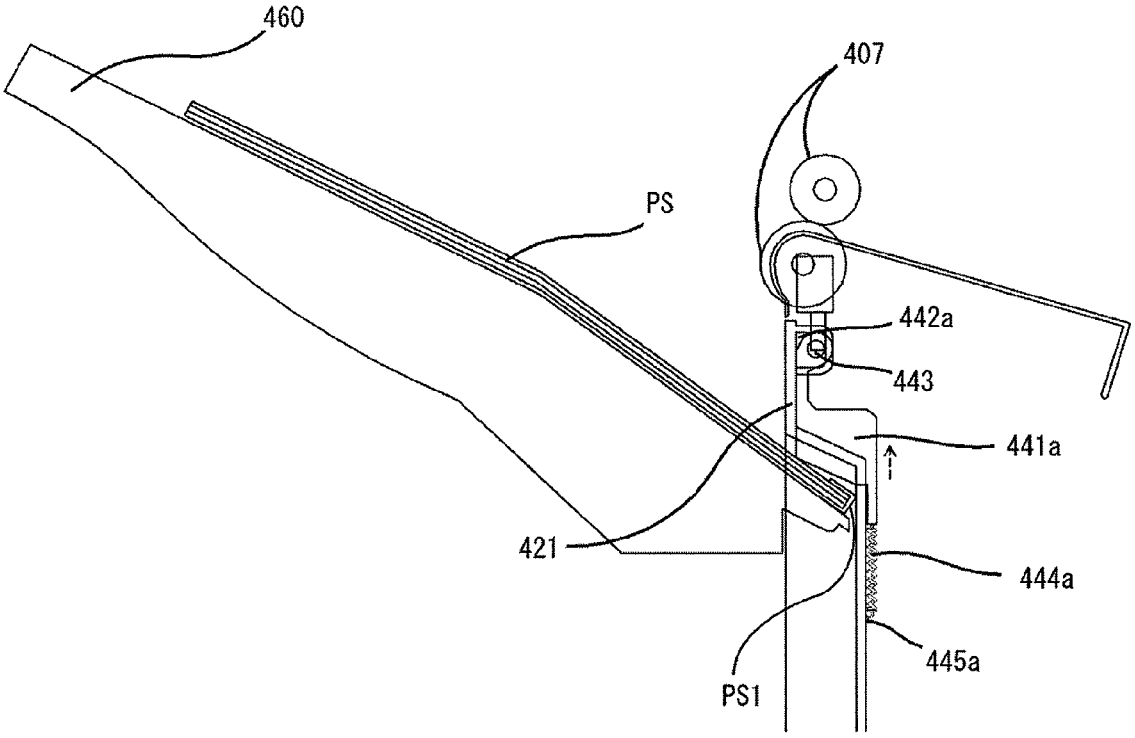
FIG. 38 is a cross-sectional view illustrating an operational procedure of the sheet post-processing device.

After the end of the bound sheet bundle PS slides down from the recess 422 formed on the wall body 421 as illustrated in FIG. 36, the tray 460 is lifted again by the tray lifting unit 305 as illustrated in FIG. 37. If the bound sheet bundle PS loaded in the tray 460 makes contact with the push plates 441*a*, 441*b*, 441*c*, and 441*d* of the elastic member 440 as a result of lifting of the tray 460, the push plates 441*a*, 441*b*, 441*c*, and 441*d* are slightly upwardly lifted with an elastic resistance as illustrated in FIG. 38. For this reason, the end of bound sheet bundle PS is pressedly loaded between the push plates 441*a*, 441*b*, 441*c*, and 441*d* and the tray 460.

Figure 39:
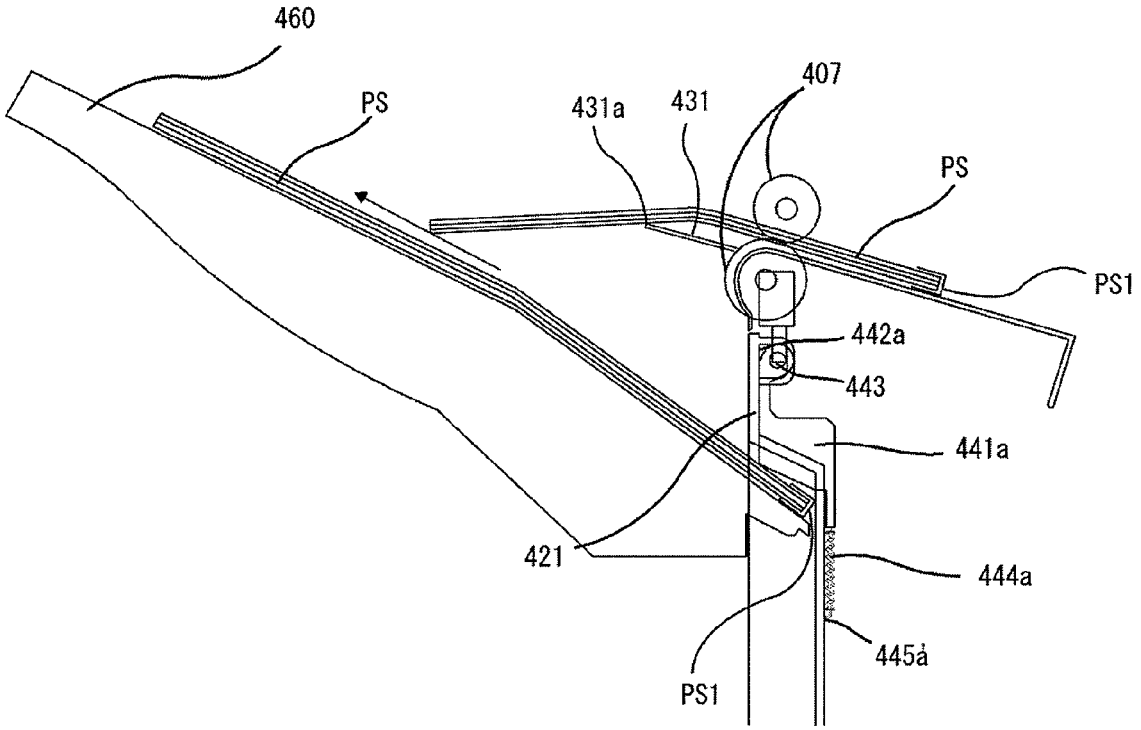
FIG. 39 is a cross-sectional view illustrating an operational procedure of the sheet post-processing device.

The timing for stopping lifting of the tray 460 is controlled such that the loading height position detection sensor SW3 described above detects the loading position of the bound sheet bundle PS. After the first bound sheet bundle PS is loaded, the second bound sheet bundle PS is discharged to the tray 460 through a group of discharge rollers 405, 406, and 407 as illustrated in FIG. 39. When the second bound sheet bundle PS is discharged to the tray 460 through the roller 406, the second bound sheet bundle PS is supported by the extension guides 431 and 432. Therefore, it is possible to prevent the leading end of the bound sheet bundle PS from being discharged along an arc due to a gravity force. In addition, it is possible to prevent the leading end of the bound sheet bundle PS from interfering with the already discharged bound sheet bundle PS to push the already discharged bound sheet bundle PS and generate a deviation. Therefore, it is possible to guarantee the alignment of the aligned bound sheet bundle PS.

Figure 40:
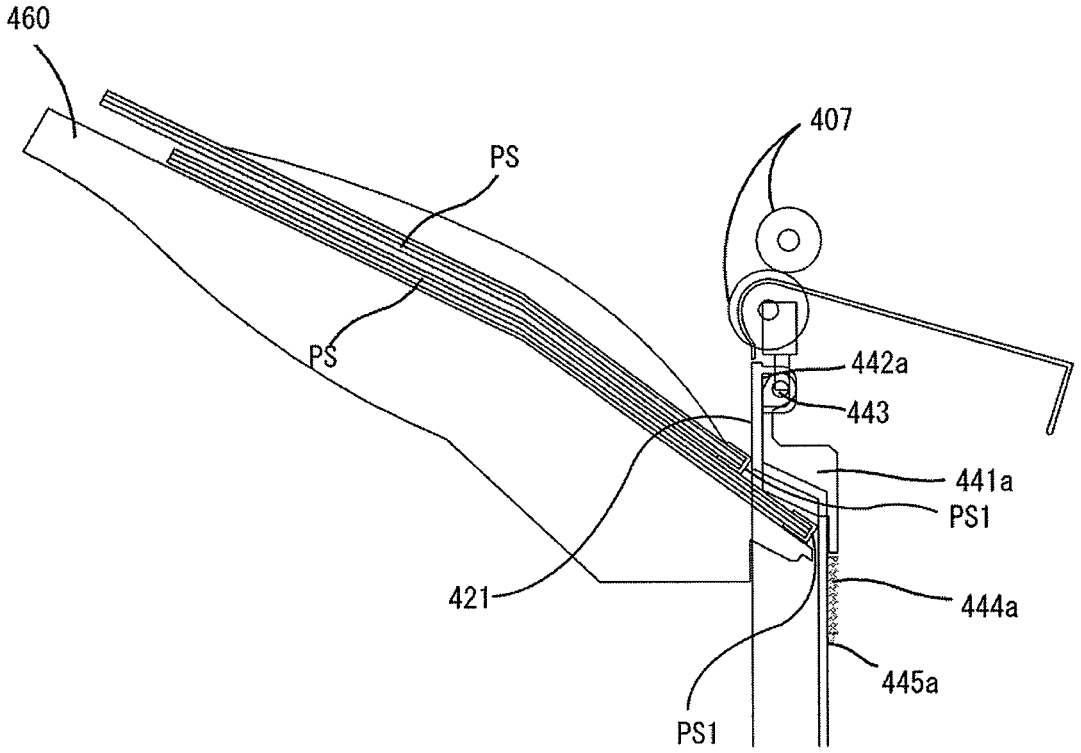
FIG. 40 is a cross-sectional view illustrating an operational procedure of the sheet post-processing device.
Figure 41:
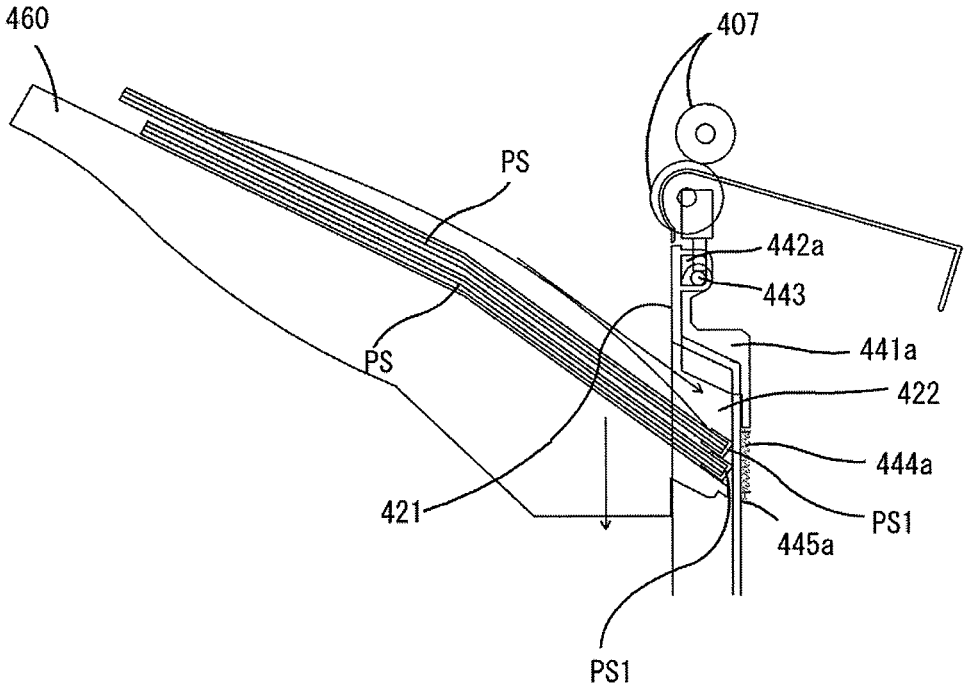
FIG. 41 is a cross-sectional view illustrating an operational procedure of the sheet post-processing device.

In addition, the second bound sheet bundle PS discharged to the tray 460 slides down to the wall body 21 by its own weight as illustrated in FIG. 40, and the tray 460 is further lowered by a predetermined interval as illustrated in FIG. 41, so that a part of the end of the second bound sheet bundle PS where a tape PS1 is attached is guided to slide down to the recess 422 formed on the wall body 421.

Figure 42:
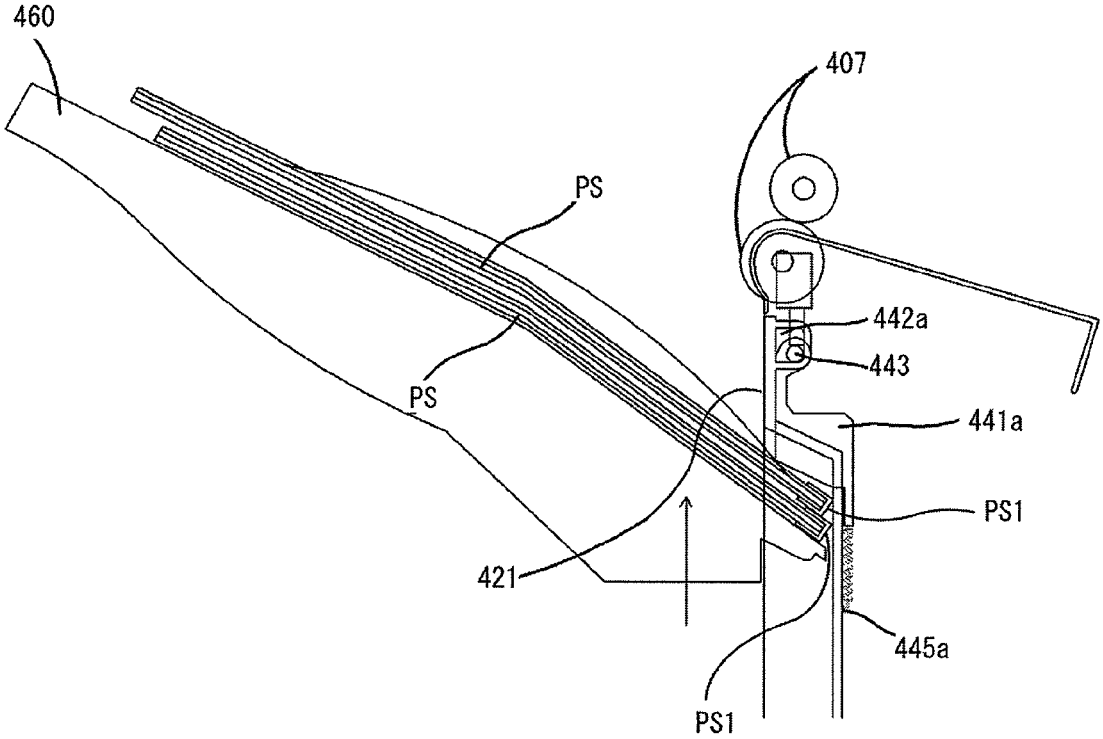
FIG. 42 is a cross-sectional view illustrating an operational procedure of the sheet post-processing device.

As illustrated in FIG. 41, after the end PS1 of the second bound sheet bundle PS slides down to the recess 22 formed in the wall body 421, the tray 460 is lifted again by the tray lifting unit 305 as illustrated in FIG. 42.

If the second bound sheet bundle PS loaded on the tray 460 makes contact with the push plates 441*a*, 441*b*, 441*c*, and 441*d* by lifting the tray 460 again as illustrated in FIG. 42, the push plates 441*a*, 441*b*, 441*c*, and 441*d* are slightly upwardly lifted with an elastic resistance so that the ends PS1 of the two bound sheet bundles PS are pressedly loaded between the push plates 441*a*, 441*b*, 441*c*, and 441*d* and the tray 460.

Figure 43:
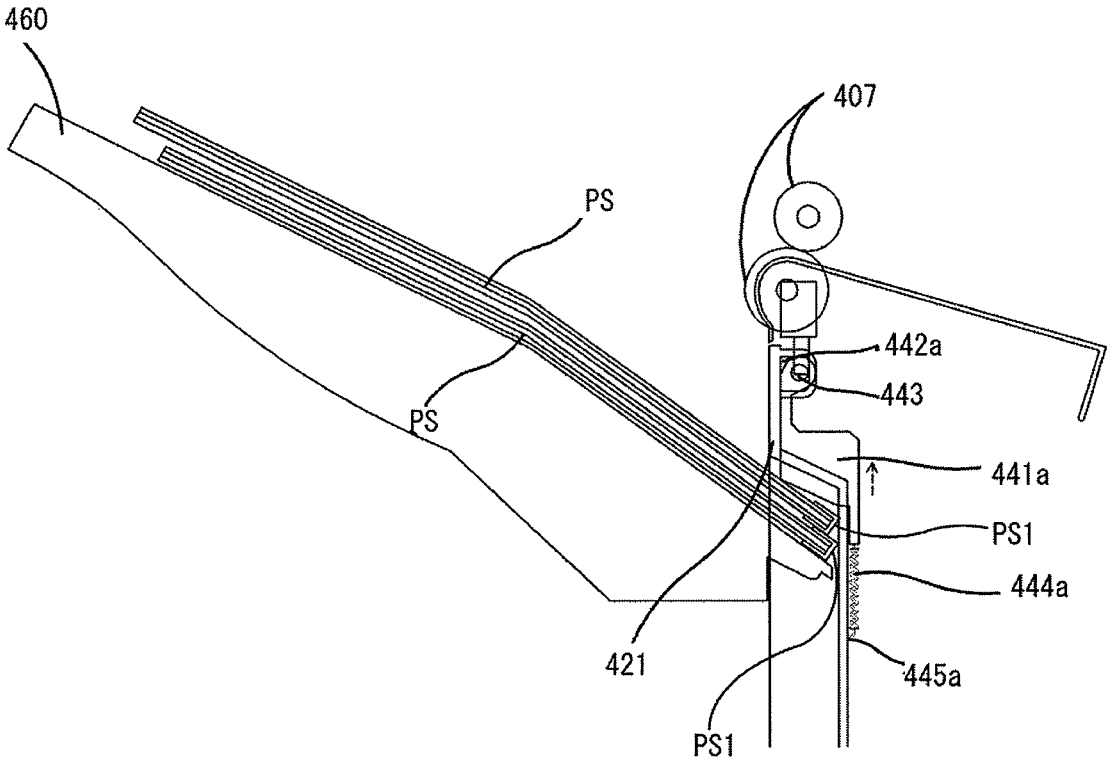
FIG. 43 is a cross-sectional view illustrating an operational procedure of the sheet post-processing device.

In this manner, while end PS1 of the two bound sheet bundles PS are pressedly loaded between the push plates 441*a*, 441*b*, 441*c*, and 441*d* and the tray 460, a recess 422 is formed in the wall body 421 where the tray 460 is lifted, and an elastic member 440 is provided in the upper end 424 of the wall body 422. Since the two bound sheet bundles PS are pressedly loaded between the tray 460 and the elastic member 440, it is possible to prevent the cover of the bound sheet bundle PS from bulging upward as illustrated in FIG. 43.

Figure 44:
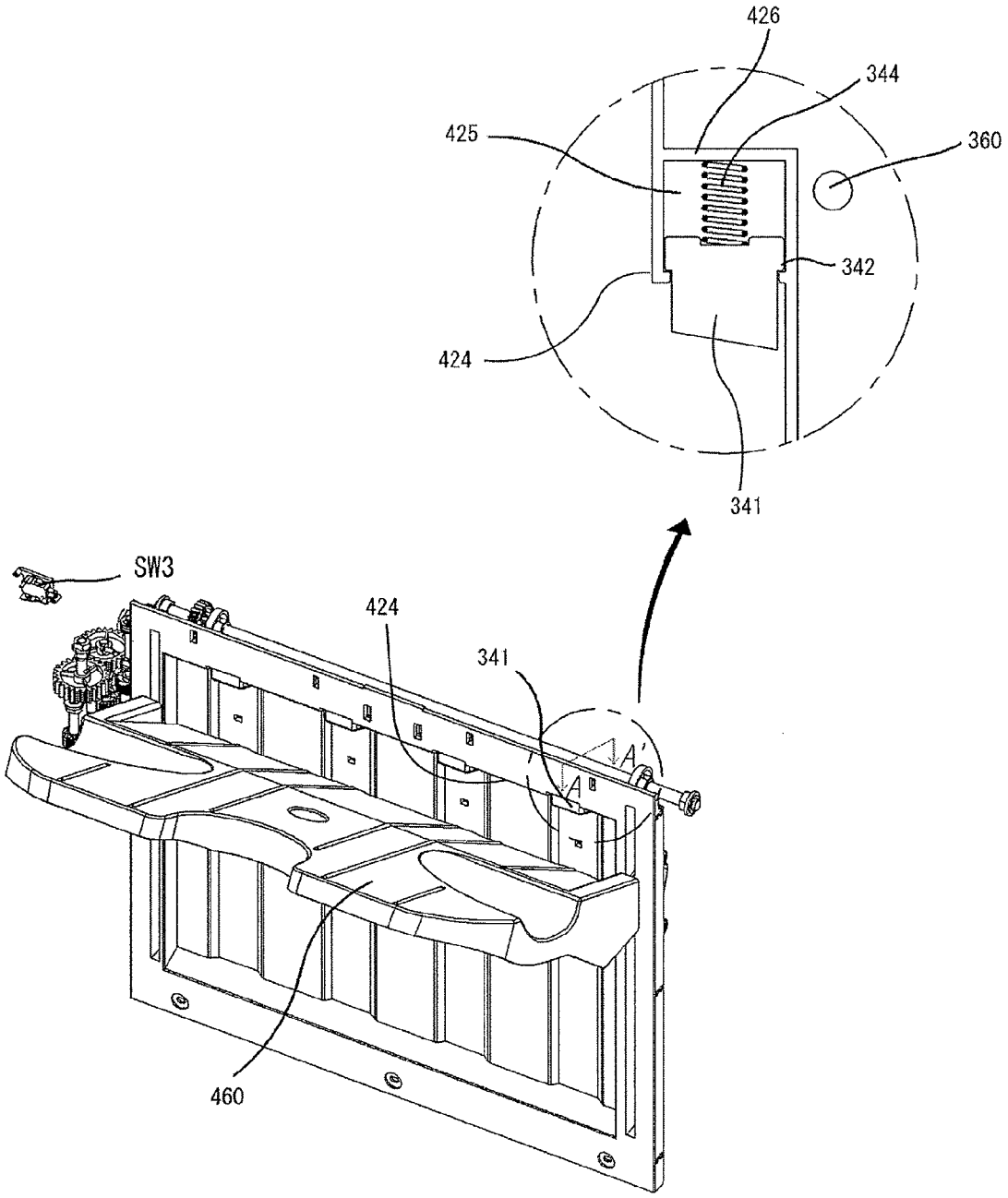
FIG. 44 is a diagram illustrating another example of an elastic member of the sheet post-processing device.

The elastic member 440 according to the embodiment is not limited to the illustrated structures of FIGS. 32 to 43. As illustrated in FIG. 44, the elastic member 440 may include the push plate 341 and the spring 344.

Specifically, as illustrated in FIG. 44, the elastic member 440 may be configured by forming a space 425 to mount the push plate 341 in the upper end 424 of the wall body 421, mounting the push plate 341 in the space 425 by insertion, and inserting a spring 344 into a gap between the supporting plate 426 formed over the space portion 425 and the push plate 341. Of course, the end 342 may be formed in the middle portion of the push plate 341 in order to prevent the push plate 341 from being separated to the outer side from the space 425.

The binding sheet loading device according to the present embodiment includes a wall body 421, a tray 460 configured to elevate along the wall surface, and an elastic member 440 configured such that the push plates 441*a*, 441*b*, 441*c*, and 441*d* protrude to the upper end of the wall body 421. When the bound sheet bundle PS loaded on the tray 460 is conveyed from the binding device provided in the copy machine (image-forming apparatus) and is loaded, all trays 460 are lowered by a predetermined interval, and then, lifted again to a position where the bound sheet bundle PS loaded on the tray 460 is pressed by the push plates 441*a*, 441*b*, 441*c*, and 441*d* of the elastic member 440.

The recess 422 is formed in the wall body 421, and the tray 460 is configured to elevate in the recess area. The elastic member 440 includes push plates 441*a*, 441*b*, 441*c*, and 441*d* inserted to protrude to the space 425 formed in the upper end step portion 424 of the wall body 421, a shaft that supports the upper ends of the push plates 441*a*, 441*b*, 441*c*, and 441*d*, shaft fixing latches 442*a*, 442*b*, 442*c* and 442*d* provided in the rear surface of the wall body 421 to flexibly fix the shaft 443 by insertion, and a spring elastically fixed between the other end of the push plates 441*a*, 441*b*, 441*c*, and 441*d* and the rear surface of the wall body 421 such that the push plates 441*a*, 441*b*, 441*c*, and 441*d*, of which a part is fixed to the shaft 443, protrude downwardly through the space 25 formed in the upper end step portion 424 of the wall body 421.

The elastic member 440 includes the push plate 341 inserted into the space 425 formed in the upper end 424 of the wall body 421 and the spring 344 interposed between the supporting plate 426. In addition, the loading height position detection sensor SW3 for detecting the loading height of the bound sheet bundle PS loaded on the tray 460 is provided in the wall body 421 so that the re-elevation position of the tray 460 is determined by the signal of the loading height position detection sensor SW3.

The sheet loading device 500 according to the present embodiment includes a tray 460 configured to elevate in the recess area 422 in the wall body 421 and the push plates 441*a*, 441*b*, 441*c*, and 441*d* serving as the elastic member 440 in the upper end 424 of the wall body 421 having the recess 422. When the bound sheet bundle PS is loaded on the tray 460, the tray 460 is lowered by a predetermined interval, and then, lifted again to a position where the binding part of the loaded bound sheet bundle PS is pressed by the push plates 441*a*, 441*b*, 441*c*, and 441*d* so that the bound sheet bundle PS is loaded while the end PS1 of the bound sheet bundle PS is pressed.

If the bound sheet bundle PS is loaded while the end PS1 of the binding part of the discharged bound sheet bundle PS is pressed, the tape part is pressed until the latent heat remaining in the binding tape is cooled. Therefore, it is possible to obtain an effect that the cover surface bonded with the tape does not bulge and is strongly bonded. In addition, since there is no additional device for cooling the latent heat, the binding quality can be improved. Moreover, it is possible to reliably discharge and load multiple bound sheet bundles PS to the tray 460.

Figure 46:
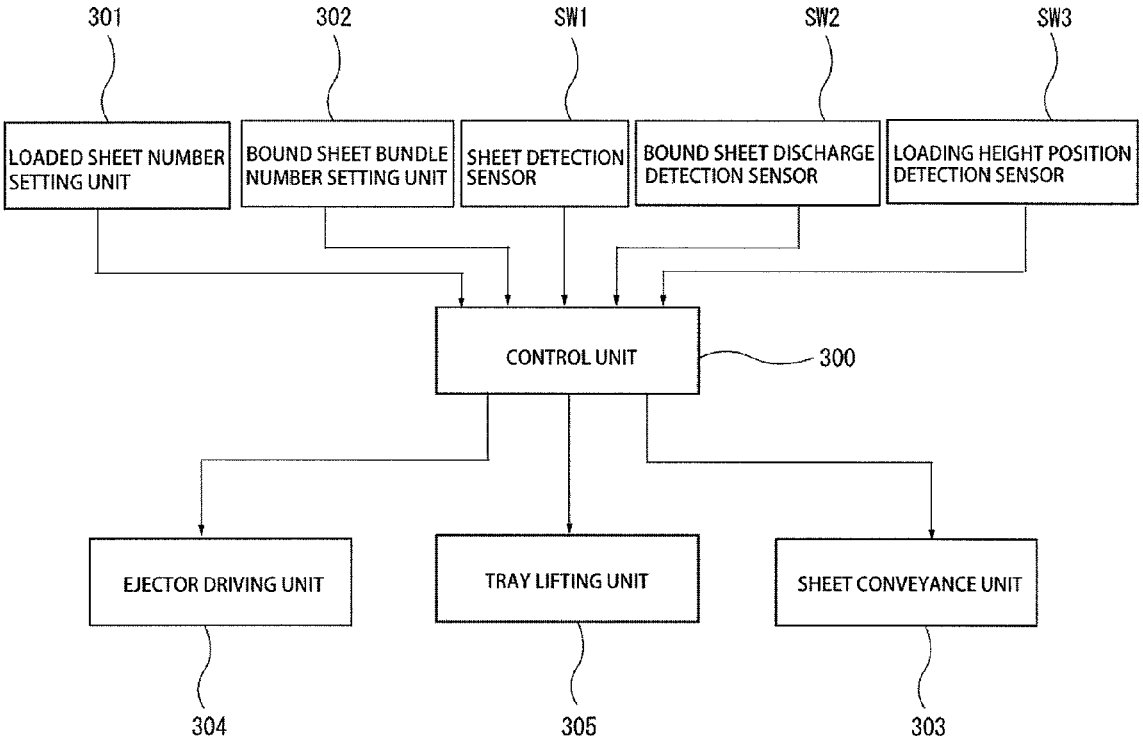
FIG. 46 is a control block diagram illustrating the sheet post-processing device.

FIG. 46 is a control block diagram illustrating the sheet processing apparatus. The sheet loading device 500 includes the control unit 300. The control unit 300 includes a microcomputer and may be configured integrally with or separately from the controller of the image forming apparatus 101. The sheet loading device 500 includes a loaded sheet number setting unit 301 for setting the number of sheets and a bound sheet bundle number setting unit 302 for setting the number of bound sheet bundles loaded on the tray 460. The loaded sheet number setting unit 301 and the bound sheet bundle number setting unit 302 may be configured integrally with or separately from each other.

The sheet loading device 500 includes a sheet conveyance unit 303, an ejector driving unit 304 for a reciprocal movement of the ejector in the sheet discharge direction, and a tray lifting unit 305 for lifting the tray 460. The sheet conveyance unit 303 includes a roller or the like and conveys the sheets conveyed from the image-forming apparatus.

The control unit 300 performs a control such that the set number of sheets loaded on the base plate 401 is computed based on the detection information of the sheet detection sensor SW1. If the set number of sheets is loaded, the binding is performed using the binding device (not illustrated). By controlling the ejector driving unit 303, the ejectors 425 and 426 move forward to discharge the bound sheet bundle PS to the tray 460 and return from the forward position to the original standby position. The tray lifting unit 304 is controlled based on the detection information of the bound sheet discharge detection sensor SW2 after a predetermined time such that the tray 460 is lowered to a position where the end PS1 of the bound sheet bundle PS slides into the recess 422 of the wall surface of the wall body 421 which liftably supports the tray 460. It is possible to avoid a phenomenon that the cover of the bound sheet bundle PS peels off or bulges and improve the binding quality.

The control unit 300 controls the tray lifting unit 304 such that the tray 460 is lifted from the position where the end PS1 of the bound sheet bundle PS slides to the recess 422 of the wall surface, the bound sheet bundle PS is interposed between the push plates 441*a*, 441*b*, 441*c*, and 441*d* and the tray 460. The loading height position detection sensor SW3 detects the loading height of the bound sheet bundle PS loaded on the tray 460. The bound sheet bundle can be reliably loaded on the tray 460 based on the detection information of the loading height of the bound sheet bundle PS. In addition, it is possible to improve the binding quality.

The control unit 300 repeats the operation for loading the bound sheet bundle PS on the tray 460. If the set number of bound sheet bundles is accomplished based on the detection number of the loading height of the bound sheet bundle PS, the control unit 300 controls the tray lifting unit 305 such that, the operation for loading the bound sheet bundle PS on the tray 460 is stopped, and then, the tray 460 is lowered to a predetermined position. As a result, the bound sheet bundle PS is not interposed between the push plates 441*a*, 441*b*, 441*c*, and 441*d* and the tray 460. Therefore, an end user can easily extract the bound sheet bundle PS from the tray 460.

Figure 47:
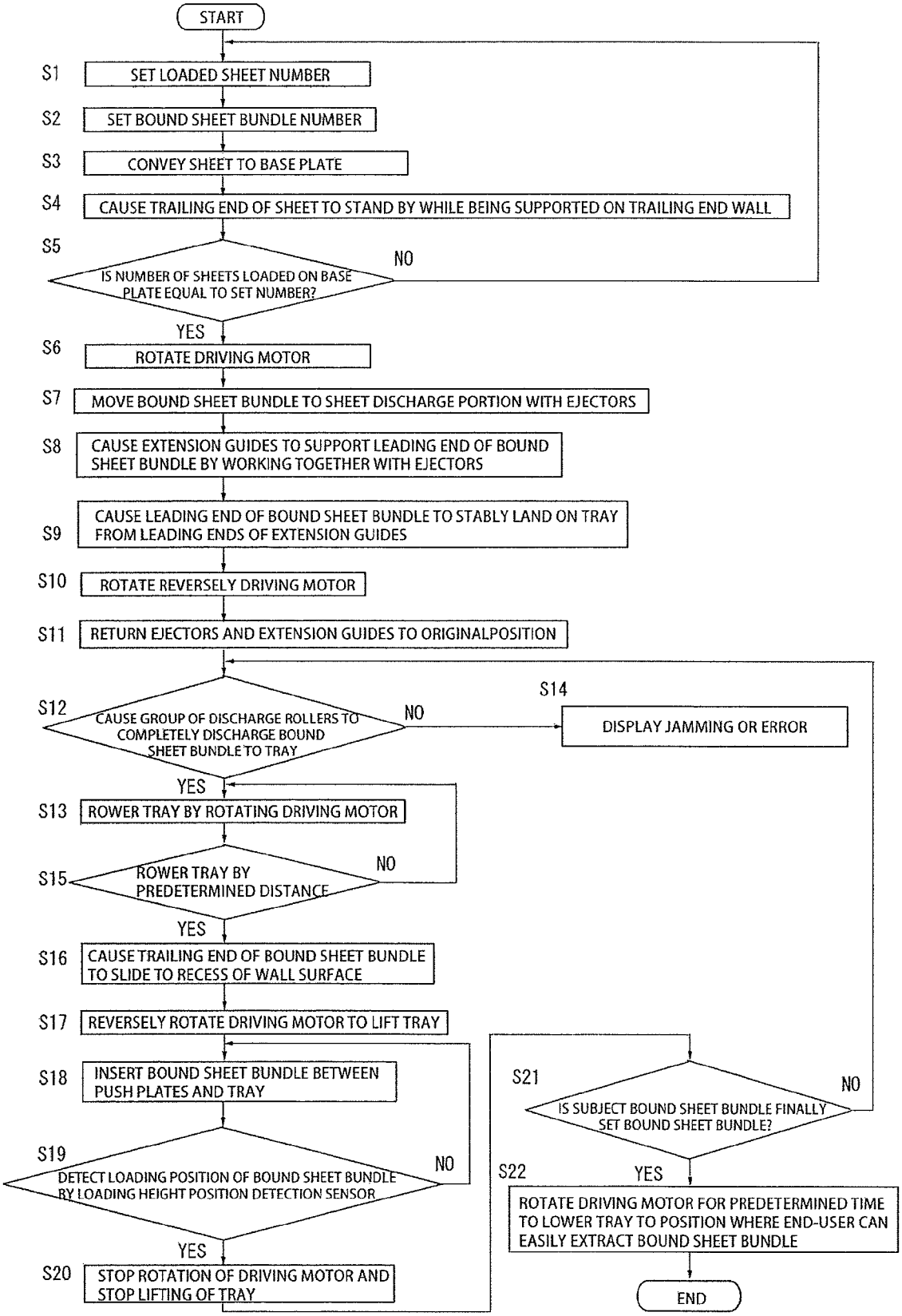
FIG. 47 is a flowchart illustrating an operation of the sheet post-processing device.

FIG. 47 is a flowchart illustrating the operation of the sheet processing apparatus. In the present embodiment, as the operation of the sheet loading device 500, the number of sheets loaded on the base plate 1 is set by the loaded sheet number setting unit 301 in step S1, and the bundle number of the bound sheet bundles PS loaded on the tray 460 is set by the bound sheet bundle number setting unit 302 in step S2. The control unit 300 performs control such that, as the sheet loaded number and the binding bundle number are set, the sheet conveyance unit 303 is driven to convey the sheet P conveyed from the image-forming apparatus, and the sheet P is conveyed to the base plate 401 in step S3. The trailing end of the sheet P is supported by the trailing end wall 2 and has a standby state in step S4.

The sheet discharge detection sensor SW1 detects the sheet P conveyed from the image-forming apparatus. It is determined whether or not sheets P of the set number are loaded on the base plate 1 based on detection information. If sheets P of the set number are loaded in step S5, the binding device (not illustrated) performs the binding. As the driving motor 450 of the ejector driving unit 304 is rotated in step S6, the bound sheet bundle PS subjected to the binding is moved by the ejectors 425 and 426 toward the sheet discharge portion 57 in step S7.

The extension guides 431 and 432 support the leading end of the bound sheet bundle PS in synchronization with the ejectors 425 and 426 in step S8. The leading end of the bound sheet bundle PS is stably seated on the tray 460 from the leading ends 431*a* and 432*a* of the extension guides 431 and 432 in step S10. As the bound sheet bundle PS is discharged to the tray 460, the driving motor 450 of the ejector driving unit 304 is reversely rotated from the discharging state in step S10 so that the ejectors 425 and 426 and the extension guides 431 and 432 return to the original standby position in step S11.

The sheet detection sensor SW2 detects that the bound sheet bundle PS is discharged to the tray 460. If a group of discharge rollers 405, 406, and 407 completely discharge the bound sheet bundle PS to the tray 460 based on the detection information in step S12, the driving motor 350 is rotated, and the tray 460 is lowered in step S13. If the bound sheet bundle PS is not discharged to tray 460, a jam or an error is displayed in step S14.

If the tray 460 is lowered by a predetermined distance set in advance by rotating the driving motor 350 in step S15, the trailing end of the bound sheet bundle PS slides to the recess 422 of the wall surface of the wall body 421 in step S16. Moreover, the driving motor is reversely rotated to lift the tray 460 in step S17. The bound sheet bundle PS is interposed between the push plates 441*a*, 441*b*, 441*c*, and 441*d* and the tray 460 in step S18.

Until the loading height position detection sensor SW3 detects the loading height of the bound sheet bundle PS, the driving motor 350 is reversely rotated to lift the tray 460. If the loading height of the bound sheet bundle PS is detected, the driving motor 350 stops, and the lifting of the tray 460 stops in step S20.

The number of bound sheet bundles PS is computed based on a frequency that the loading height position detection sensor SW3 detects the loading position of the bound sheet bundle PS, and it is determined whether or not a final set number of sheet bundles is accomplished in step S21. If the final sheet bundle is not reached, the process advances to step S12, and the process is repeated until the bound sheet bundle PS reaches the final set number of sheet bundles. If the final set number of sheet bundles is reached, the driving motor 350 is rotated for a predetermined time to lower the tray 460 to the position where an end user can easily extract the bound sheet bundle PS in step S22.

The present invention can be applied to a sheet processing apparatus which is a peripheral of an image-forming apparatus such as a printer, a copy machine, and a printing machine. It is possible to buffer a certain number of sheets in the sheet conveying path and improve the processing capacity by rapidly discharging the buffered sheets.

What is claimed is:

1. A sheet processing apparatus comprising a sheet buffer device configured to stack and buffer a predetermined number of sheets in a sheet conveying path for conveying a sheet carrying an image recorded thereon, the sheet buffer device comprising:

a buffer conveying path configured to stack the predetermined number of sheets;

a pair of sheet entrance rollers disposed on an entrance side of the buffer conveying path;

a pair of sheet discharge rollers disposed on a discharge side of the buffer conveying path and separated from the pair of sheet entrance rollers by a predetermined distance;

a driving unit configured to drive the pair of sheet entrance rollers and the pair of sheet discharge rollers;

a sheet guide unit configured to guide sheets, the sheet guide unit being provided between the pair of sheet entrance rollers and the pair of sheet discharge rollers to allow the sheets passing through the pair of sheet entrance rollers to be sequentially stacked;

a paddle disposed to smoothly convey the sheet in the buffer conveying path;

a clutch unit configured to control driving of the pair of sheet discharge rollers;

at least one sheet sensor configured to detect conveyance of the sheet to a predetermined position in the sheet conveying path; and a controller configured to accelerate rotation of the pair of sheet discharge rollers relative to rotation of the pair of sheet entrance rollers, wherein the buffer conveying path is S-shaped and formed by a concave-shaped entrance conveying path portion and a convex-shaped discharge conveying path portion provided between opposed guide plates, the sheet guide unit is disposed at the concave-shaped entrance conveying path portion, the paddle is disposed at the convex-shaped discharge conveying path portion, the sheet guide unit is configured such that when a trailing edge of the sheet that is conveyed by being nipped by the pair of sheet entrance rollers is released from a nipping position, the concave-shaped entrance conveying path portion changes direction from the nipping position, the sheet that has passed through the pair of sheet entrance rollers is stacked in the buffer conveying path such that the stacked sheets pass through the pair of sheet discharge rollers and overlap, with each leading edge of the stacked sheets separated by a predetermined interval, the paddle conveys the sheet along the convex-shaped discharge conveying path portion, and the controller controls the clutch unit based on a signal of the sheet sensor such that the driving motor is driven after a predetermined time to rotate the pair of sheet discharge rollers, the pair of sheet discharge rollers are continuously rotated for a particular time, and the stacked sheets pass through the pair of sheet discharge rollers while being loaded with each leading edge of the stacked sheets being separated by a predetermined interval.

2. A sheet processing apparatus comprising a sheet buffer device configured to stack and buffer a predetermined number of sheets in a sheet conveying path for conveying a sheet carrying an image recorded thereon, the sheet buffer device comprising:

a buffer conveying path configured to stack the predetermined number of sheets;

a pair of sheet entrance rollers disposed on an entrance side of the buffer conveying path;

a pair of sheet discharge rollers disposed on a discharge side of the buffer conveying path and separated from the pair of sheet entrance rollers by a predetermined distance;

a driving unit configured to drive the pair of sheet entrance rollers and the pair of sheet discharge rollers;

a sheet guide unit configured to guide sheets, the sheet guide unit being provided between the pair of sheet entrance rollers and the pair of sheet discharge rollers to allow the sheets passing through the pair of sheet entrance rollers to be sequentially stacked;

a paddle disposed to smoothly convey the sheet in the buffer conveying path;

a clutch unit configured to control driving of the pair of sheet discharge rollers;

at least one sheet sensor configured to detect conveyance of the sheet to a predetermined position in the sheet conveying path; and a controller for accelerating rotation of the pair of sheet discharge rollers relative to rotation of the pair of sheet entrance rollers, the controller controlling the clutch unit based on a signal of the sheet sensor such that the driving motor is driven after a predetermined time to rotate the pair of sheet discharge rollers, the pair of sheet discharge rollers are continuously rotated for a particular time, and the stacked sheets pass through the pair of sheet discharge rollers while being loaded on a step with each leading edge of the stacked sheets being separated by a predetermined interval, wherein the driving unit has a power transmission unit and a driving motor, the paddle, the pair of sheet entrance rollers and the pair of sheet discharge rollers are rotated together by the power transmission unit by driving the driving motor wherein the buffer conveying path is S-shaped and includes a concave-shaped entrance conveying path portion and a convex-shaped discharge conveying path portion provided between opposed guide plates, the sheet guide unit is disposed at the concave-shaped entrance conveying path portion, the paddle is disposed at the convex-shaped discharge conveying path portion, the sheet guide unit is configured such that when a trailing edge of the sheet that is conveyed by being nipped by the pair of sheet entrance rollers is released from a nipping position, the concave-shaped entrance conveying path portion changes direction from the nipping position, the paddle conveys the sheet along the convex-shaped discharge conveying path portion and the sheet that has passed through the pair of sheet entrance rollers is stacked in the buffer conveying path such that the stacked sheets pass through the pair of sheet discharge rollers and overlap with each leading edge of the stacked sheets separated by a predetermined interval.

* * * * *